US008016504B2

(12) United States Patent
Tsuchiya et al.

(10) Patent No.: US 8,016,504 B2
(45) Date of Patent: Sep. 13, 2011

(54) PRINTER HAVING PLATEN ROLLER AND MODULE THAT ARE ENGAGEABLE WITH EACH OTHER FOR PRINTING ON PAPER

(75) Inventors: Masahiro Tsuchiya, Shinagawa (JP); Yukihiro Mori, Shinagawa (JP); Sumio Watanabe, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 792 days.

(21) Appl. No.: 12/068,031

(22) Filed: Jan. 31, 2008

(65) Prior Publication Data

US 2009/0016796 A1 Jan. 15, 2009

(30) Foreign Application Priority Data

Jul. 9, 2007 (JP) ..... 2007-179361

(51) Int. Cl.
*B41J 29/13* (2006.01)
*B41J 29/42* (2006.01)

(52) U.S. Cl. ..... 400/708; 400/703; 400/649

(58) Field of Classification Search ..... 400/708, 400/120.16, 703; 347/197
See application file for complete search history.

(56) References Cited

U.S. PATENT DOCUMENTS 5,570,962 A * 11/1996 Suzuki et al. ..... 400/120.16

FOREIGN PATENT DOCUMENTS

| | | | |
|---|---|---|---|
| EP | 0 672 534 A | | 9/1995 |
| EP | 1 010 537 A | | 6/2000 |
| JP | 61051372 A | * | 3/1986 |
| JP | 02108574 A | * | 4/1990 |
| JP | 2002-46321 | | 2/2002 |
| JP | 2003-312889 | | 11/2003 |
| JP | 2004-9625 | | 1/2004 |
| JP | 2004-345264 | | 12/2004 |
| WO | 94/02322 | | 2/1994 |

OTHER PUBLICATIONS

European Search Report mailed Jul. 14, 2009 and issued in corresponding European Patent Application 08101068.8.

* cited by examiner

*Primary Examiner* — Daniel J Colilla
(74) *Attorney, Agent, or Firm* — Staas & Halsey LLP

(57) ABSTRACT

A printer having a platen roller and a module that are engagable with each other for printing on paper is disclosed. The printer includes a status detecting mechanism including a detecting part having a detection function for detecting a status of the printer, a restricting part for restricting the detection function of the detecting part, and a function restriction releasing part for releasing the restricted function of the detecting part. The engagement of the platen roller and the module displaces the function restriction releasing part. The displacement causes the function restriction releasing part to release the restricted function of the detecting part.

19 Claims, 26 Drawing Sheets

FIG.1

| | | PLATEN ROLLER | |
|---|---|---|---|
| | | ENGAGED | INSUFFICIENT ENGAGEMENT (DISENGAGED) |
| THERMAL PAPER | WITHOUT PAPER | <2> | <1> |
| | WITH PAPER | <4> | <3> |

PRINTER HAVING PLATEN ROLLER AND MODULE THAT ARE ENGAGEABLE WITH EACH OTHER FOR PRINTING ON PAPER

BACKGROUND OF THE INVENTION

1. Field of the Invention

The present invention generally relates to printers, and more particularly to thermal printers having a thermal head serving as a printing head and a configuration allowing a platen roller to be mounted.

2. Description of the Related Art

In a printer of a stationary type POS terminal or a portable printer, a thermal head is provided as a printing head. Furthermore, one example of the portable printer is a clamshell type printer in which a thermal paper roll and its paper can be easily mounted. The clamshell type printer has a rotative openable lid that covers a thermal paper roll installing chamber in to which the thermal paper roll is installed. A platen roller is provided on a tip of this lid. When the lid is closed in a state and paper is pulled out from the thermal paper roll, the thermal paper roll is installed in the thermal paper roll installing chamber and the platen roller presses against a thermal head that is mounted onto a module of the printer. Thereby, the platen roller engages the module, so that the paper is set (sandwiched) between the platen roller and the thermal head and is ready for printing. In a case of exchanging the thermal paper roll for a new thermal paper roll after printing is continued for a certain period, the lid is rotatively opened. When the lid is rotatively opened, the platen roller disengages from the module. In other words, the clamshell type printer includes a platen roller that is engageable with its module.

In one example of a conventional thermal printer having an engageable platen roller, the thermal printer includes a sensor for determining (detecting) whether the platen roller is properly engaged with the module and another sensor for determining (detecting) whether there is paper sandwiched between the platen roller and the thermal head. In a case where the thermal printer is operated where the platen roller is not appropriately engaged or operated where there is no paper sandwiched between the platen roller and the thermal head, the thermal head may be damaged.

As another example of a conventional thermal printer having an engageable platen roller, there is a thermal printer whose number of sensors is reduced to a single sensor for reducing manufacturing cost. Accordingly, the thermal printer uses the single sensor to determine (detect) whether the platen roller is properly engaged and whether there is paper sandwiched between the platen roller and the thermal head.

FIG. 1 is a table showing the four states of a thermal printer having an engageable platen roller.

In the table shown in FIG. 1, <1> indicates a state where the platen roller is not properly engaged (disengaged) while there is no paper; <2> indicates a state where the platen roller is engaged while there is no paper; <3> indicates a state where the platen roller is not properly engaged while there is paper; and <4> indicates a state where the platen roller is engaged while there is paper.

FIGS. 2A-2E are schematic diagrams for describing a first example of a conventional thermal printer disclosed in Japanese Laid-Open Patent Application No. 2002-46321. As shown in FIG. 2A, the thermal printer includes a main body 1, a thermal head 2, a platen roller 3, an optical sensor 4, and a wire spring 5. The optical sensor 4 includes a light emitting part 4*a* and a light receiving part 4*b*. The optical sensor 4 is located at an area slightly separated from the area directly below the platen roller 3. The wire spring 5 has a U-shape when observed from above. The wire spring 5 is provided in the area where the optical sensor 4 is located. In FIGS. 2A-2E, reference numeral 10 indicates thermal paper.

As shown in FIG. 2B, when the platen roller 3 becomes engaged by closing a lid (not shown) where the paper 10 is drawn out along the thermal head 2, the paper 10 is sandwiched between the platen roller 3 and the thermal head 2, the platen roller 3 is pressed against the wire spring 5, and a part 10*a* of the paper 10 is positioned in the vicinity of the optical sensor 4 substantially directly below the platen roller 3. The light emitted from the light emitting part 4*a* is reflected from the paper 10 and directed to the light receiving part 4*b*. Thereby, the light receiving part 4*b* outputs high voltage. In other words, in the state <4> of FIG. 2B, the voltage output from the light receiving part 4*b* is high. In the state <2> where the platen roller 3 is engaged while there is no paper 10 as shown in FIG. 2C, the light emitted from the light emitting part 4*a* is not reflected and no voltage (0 voltage) is output from the light receiving part 4*b*. In the state <3> where the platen roller 3 is not properly engaged while there is paper 10 as shown in FIG. 2D, the light reflected to the light receiving part 4*b* is little due to the paper 10 being positioned substantially away from the optical sensor 4. Thus, low voltage is output from the light receiving part 4*b*. In the state <1> where the platen roller 3 is not properly engaged while there is no paper 10 as shown in FIG. 2E, no voltage (0 voltage) is output from the light receiving part 4*b*. In other words, as shown in FIGS. 2C-2E, the voltage output from the light receiving part 4*b* is either 0 voltage or low voltage in the states of <1>, <2>, and <3>.

Accordingly, detection can be achieved in the state of <4> of FIG. 2B.

FIGS. 3A-3E are schematic diagrams for describing a second example of a conventional thermal printer disclosed in Japanese Laid-Open Patent Application No. 2004-345264. As shown in FIG. 3A, the thermal printer includes a main body 21, a thermal head 22, a platen roller 23, and a load sensing type sensor 24. The load sensing type sensor 24 is located at an area slightly separated from the area directly below the platen roller 23.

As shown in FIG. 3B, when the platen roller 23 becomes engaged by closing a lid (not shown) where the paper 10 is drawn out along the thermal head 22, the paper 10 is sandwiched between the platen roller 23 and the thermal head 22, and a part 10*a* of the paper 10 is pressed against the load sensing type sensor 24. Thereby, the load sensing type sensor 24 is switched on. In other words, in the state <4> of FIG. 3B, the load sensing type sensor 24 is switched on.

In the state <2> where the platen roller 23 is engaged while there is no paper 10 as shown in FIG. 3C, no pressing force is applied against the load sensing type sensor 24. Thereby, the load sensing type sensor 24 remains off. In the state <3> where the platen roller 23 is not properly engaged while there is paper 10 as shown in FIG. 3D, a part 10*a* of the paper 10 is positioned away from the load sensing type sensor 24. Accordingly, no pressing force is applied against the load sensing sensor 24. Thereby, the load sensing type sensor 24 remains off. In the state <1> where the platen roller 23 is not properly engaged while there is no paper 10 as shown in FIG. 3E, no pressing force is applied against the load sensing sensor 24. Thereby, the load sensing type sensor 24 remains off. In other words, as shown in FIGS. 3C-3E, the load sensing type sensor 24 remains off in the states of <2>, <3>, and <1>.

Accordingly, detection can be achieved in the state of <4> of FIG. 3B.

However, in the first example of the conventional thermal printer shown in FIGS. 2A-2E, the optical sensor 4 is constantly exposed. In the state <3> shown in FIG. 2D where the paper 10 is pressed upward by the wire spring 5, the part 10*a* of the paper 10 is positioned away from the optical sensor 4 in a floating manner. However, in case where the paper 10 is excessively loosened (sagging), the part 10*a* of the paper 10 may be positioned in the vicinity of the optical sensor 4. Since the optical sensor 4 is exposed, the optical sensor 4 may erroneously determine that the current state is <4> even though the actual current state is <3>.

In a case where the optical sensor 4 erroneously determines that the current state is <4>, the paper 10 cannot be properly delivered even when the motor and the thermal head are driven by activating a printing operation. This leads to problems such as the thermal head 2 being damaged by heat.

Meanwhile, with the second example of the conventional thermal printer shown in FIGS. 3A-3E, in the state <3> shown in FIG. 3D, the load sensing type sensor 24 may be switched on even though the actual engagement of the platen roller 23 is insufficient in a case where the paper 10 is highly tensioned. Thus, the load sensing type sensor 24 may erroneously determine that the current state is <4>.

Likewise, in a case where the load sensing type sensor 24 erroneously determines that the current state is <4>, the paper 10 cannot be properly delivered even when the motor and the thermal head are driven by activating a printing operation. This leads to problems such as the thermal head 22 being damaged by heat.

SUMMARY OF THE INVENTION

The present invention may provide a printer that substantially obviates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a printer particularly pointed out in the specification in such full, clear, concise, and exact terms as to enable a person having ordinary skill in the art to practice the invention.

To achieve these and other advantages and in accordance with the purpose of the invention, as embodied and broadly described herein, the present invention provides a printer having a platen roller and a module that are engagable with each other for printing on paper, the printer including a status detecting mechanism including a detecting part having a detection function for detecting a status of the printer; a restricting part for restricting the detection function of the detecting part; and a function restriction releasing part for releasing the restricted function of the detecting part; wherein the engagement of the platen roller and the module displaces the function restriction releasing part, wherein the displacement causes the function restriction releasing part to release the restricted function of the detecting part.

Furthermore, an embodiment of the present invention provides a portable device including the printer according to the embodiment of the present invention.

Other objects and further features of the present invention will be apparent from the following detailed description when read in conjunction with the accompanying drawings.

BRIEF DESCRIPTION OF THE DRAWINGS

FIG. 1 is a table for describing the states of a thermal printer including an engagable platen roller;

DESCRIPTION OF THE PREFERRED EMBODIMENTS

In the following, embodiments of the present invention are described with reference to the accompanying drawings.

Figure 4:
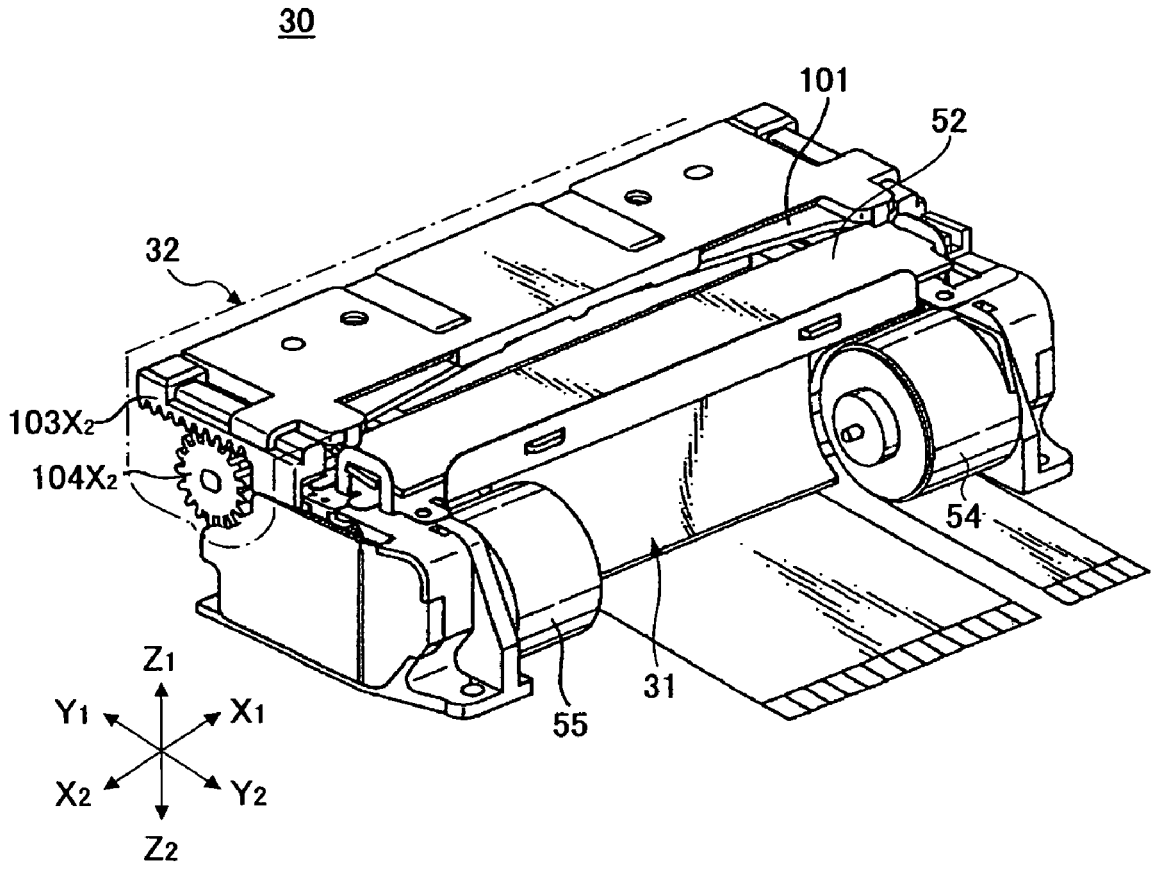
FIG. 4 is a perspective view showing a thermal printer according to a first embodiment of the present invention.

FIG. 4 is a schematic diagram showing a thermal printer 30 according to a first embodiment of the present invention in FIG. 4, arrows X1-X2 indicate the width (horizontal) direction of the thermal printer 30, arrows Y1-Y2 indicate the depth (longitudinal) direction of the thermal printer 30, and arrows Z1-Z2 indicate the height direction of the thermal printer 30.

Figure 5:
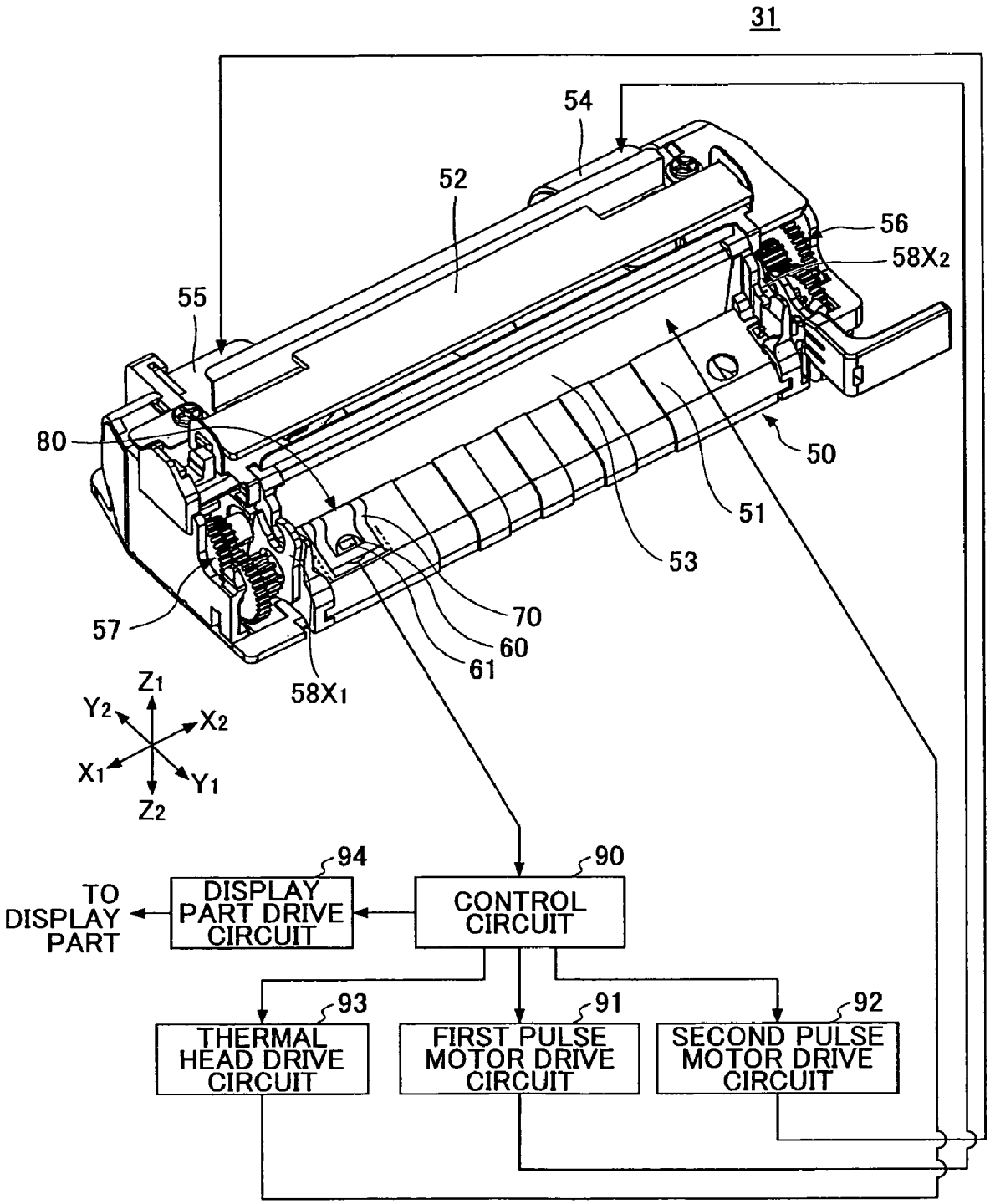
FIG. 5 is a schematic diagram showing a first module according to an embodiment of the present invention.
Figure 6:
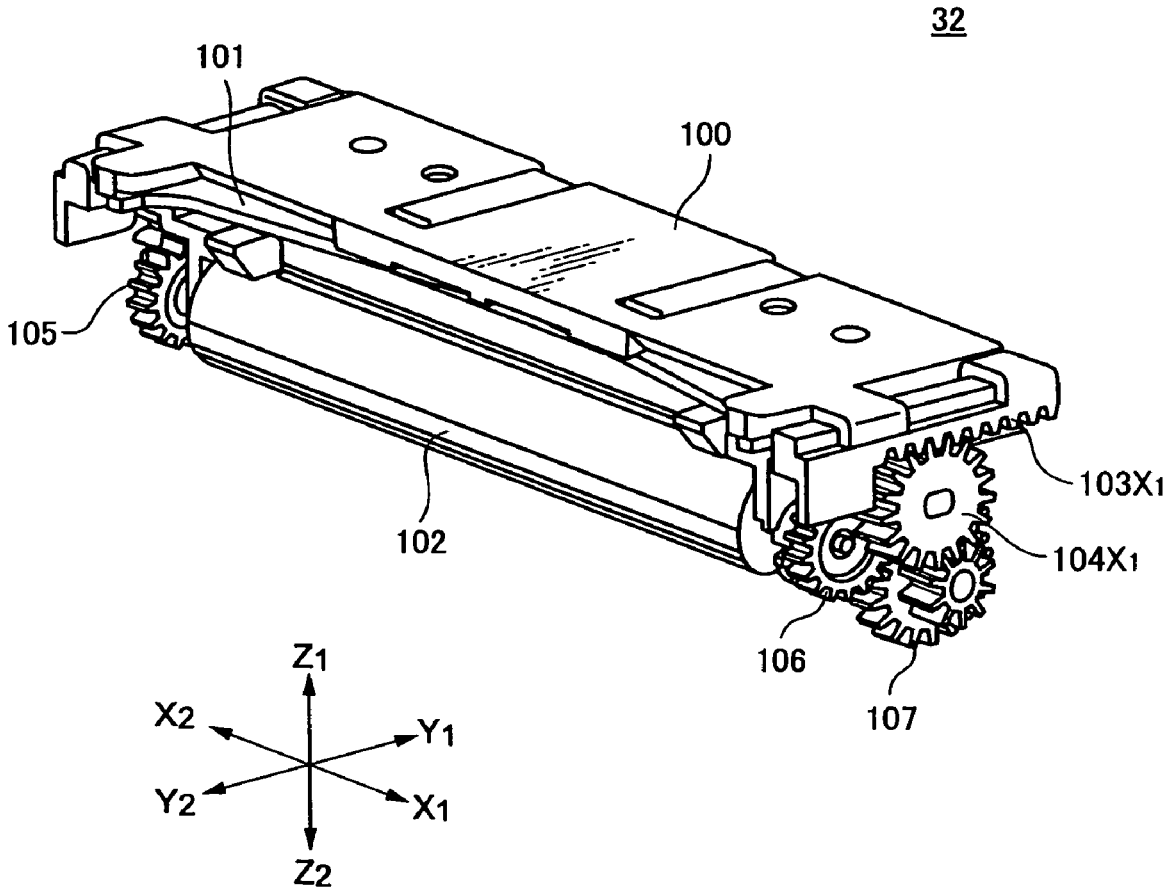
FIG. 6 is a perspective view showing a second module according to an embodiment of the present invention.

The thermal printer 30 includes a first module 31 (see FIG. 5) and a second module 32 (see FIG. 6). The second module 32 has a platen roller 102 which is engagable with the first module 31.

Figure 7A:
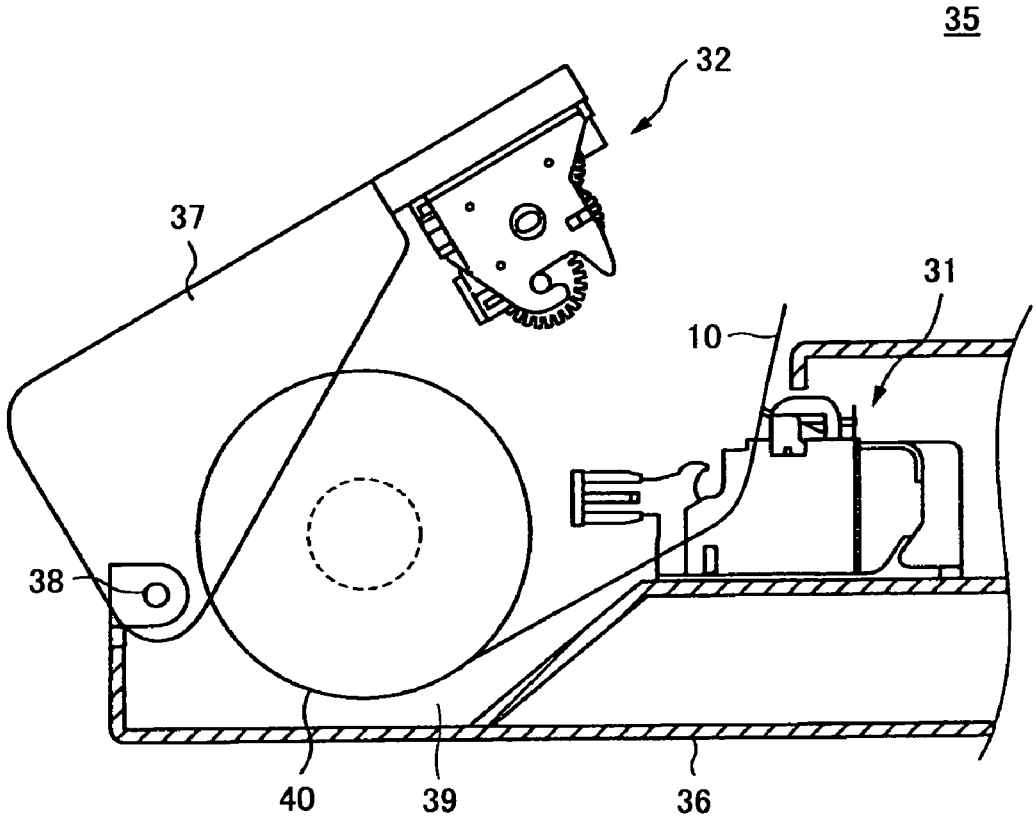
FIGS. 7A-7B are schematic diagrams showing a portable device according to an embodiment of the present invention.
Figure 7B:
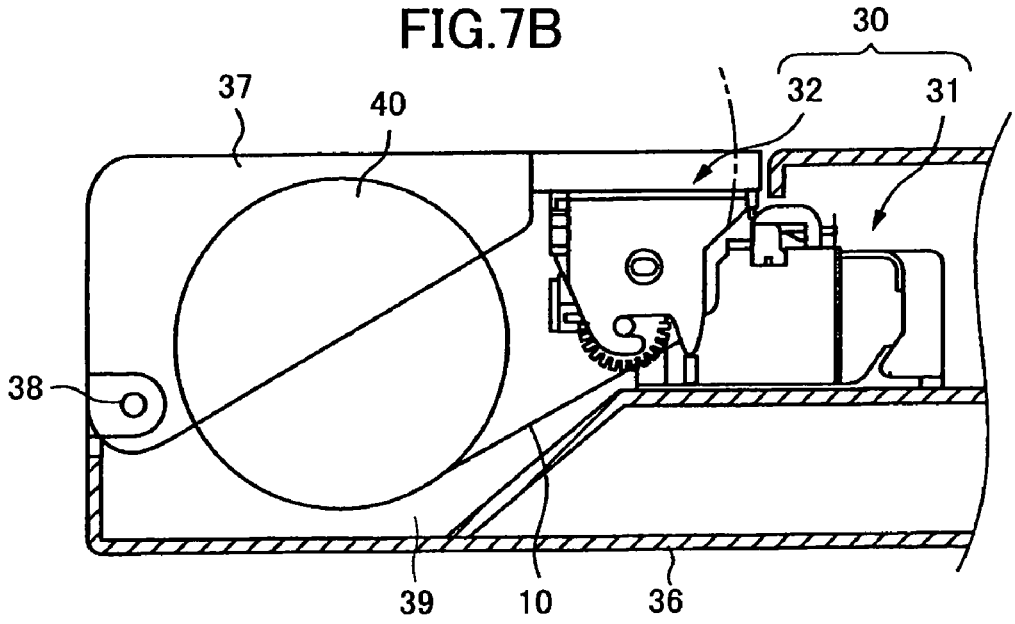

The thermal printer 30 is assembled into a portable device 35 shown in FIGS. 7A and 7B. The first module 31 is fixed to a casing 36. The second module 32 is fixed to the tip of an openable lid 37. The openable lid 37 is supported to the casing 36 via an axle 38. FIG. 7A shows the openable lid 37 opened so that the second module 32 is disengaged from the first module 31 and a thermal paper roll installing chamber 39 is open. After opening the openable lid 37, the user installs a thermal paper roll 40 in the thermal paper roll installing chamber 39, pulls a thermal paper (hereinafter also simply referred to as "paper") 10 from the thermal paper roll 40, and closes the openable lid 37 by pressing the openable lid 37. FIG. 7B shows the openable lid 37 closed so that the thermal paper roll installing chamber 39 becomes closed, the second module 32 engages the first module 31, and the thermal paper 10 becomes sandwiched between the first module 31 and the second module 32. Thereby, the thermal printer 30 can print.

[First Module 31]

As shown in FIG. 5, the first module 31 has a frame 50. The frame 50 has attached, for example, a fixed blade member 52, a thermal head (printing part) 53, first and second pulse motors 54, 55, first and second reduction gear arrays 56, 57, platen roller locking members 58X1, 58X2, an optical sensor (detecting part) 60, and a shutter member (function restriction releasing part) 70.

The frame 50 has a paper guiding part 51 provided toward the Y1 direction for guiding the paper 10.

The thermal head 53 includes an arrangement (alignment) of heating parts in which a heating part(s) designated in accordance with a supplied drive signal is heated. The thermal head 53 is positioned in an erect manner on the Y2 side of the paper guiding part 51.

The first pulse motor 54 is for driving the first reduction gear array 56. The second pulse motor 55 is for driving the second reduction gear array 57.

The optical sensor 60 and the shutter member 70 are provided in the paper guiding part 51. The optical sensor 60 and the shutter member 70 serve as a status detecting mechanism 80. That is, the optical sensor 60 is positioned at an area in the paper guiding part 51 to be covered by the paper 10. FIGS. 8-10B show enlarged views of the status detecting mechanism 80.

Figure 8:
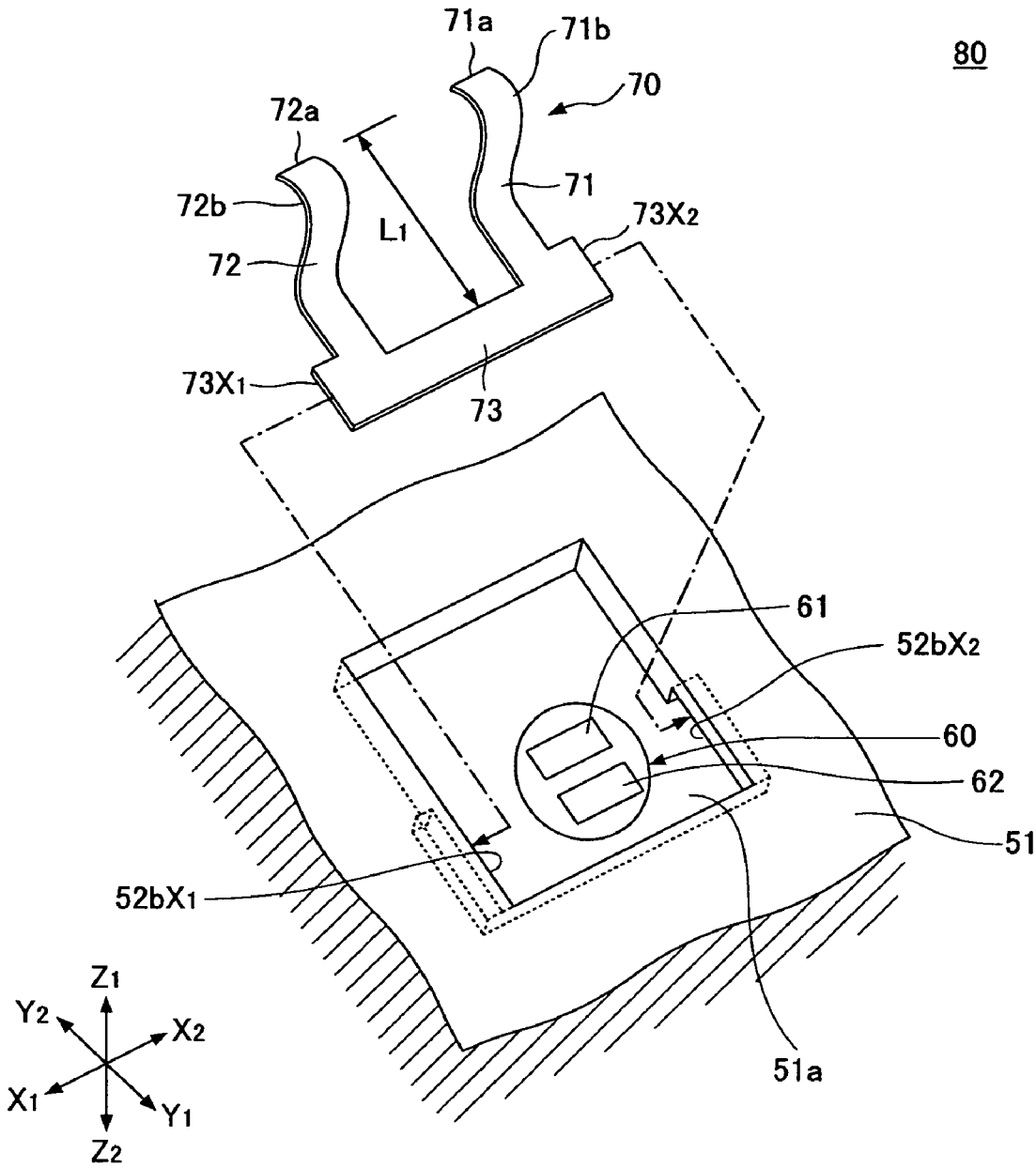
FIG. 8 is a schematic diagram showing a status detecting mechanism according to an embodiment of the present invention.

As shown in FIG. 8, the optical sensor 60 include a light emitting part 61 and a light receiving part 62 which are aligned adjacent to each other in the Y1-Y2 direction.

The shutter member 70 has a substantially U-shape. The shutter member 70 may be, for example, a metal plate member, a rubber member, or an elastomer plate member. The shutter member 70 has two parallel arm parts 71, 72 and a shutter main body 73 connecting the ends of the arm parts 71, 72. The arm parts 71, 72 have arcuate curved portions 71*b*, 72*b* in the vicinity of base portions 71*a*, 71*b*. The arcuate curved portions 71*b*, 72*b* project in the Z1 direction (i.e. in the direction of the platen roller 102). The arcuate curved portions 71*b*, 72*b* are made relatively flat by being subjected to plastic deformation and being flattened by pressure. The shutter main body 73 is formed in a size capable of covering the light receiving part 62. The shutter main body 73 has protruding parts 73X1, 73X2 provided one on each of its sides. It is, however, to be noted that the shutter member 70 may be configured having a single arm part (71 or 72).

The paper guiding part 51 includes a shallow groove part 51*a* having a shape corresponding to the shape of the shutter member 70. The optical sensor 60 is fixed to the paper guiding part 51 by being buried in the paper guiding part 51. The buried optical sensor 60 is partly exposed in the shallow groove part 51*a*. The paper guiding part 51 also includes guiding grooves (guiding parts) 51*b*X2, 51*b*X1 provided in the X2 and X1 directions, respectively. The guiding grooves 51*b*X1, 51*b*X1 can be formed by expanding the shallow groove part 51*a* in the X1-X2 directions.

Figure 10A:
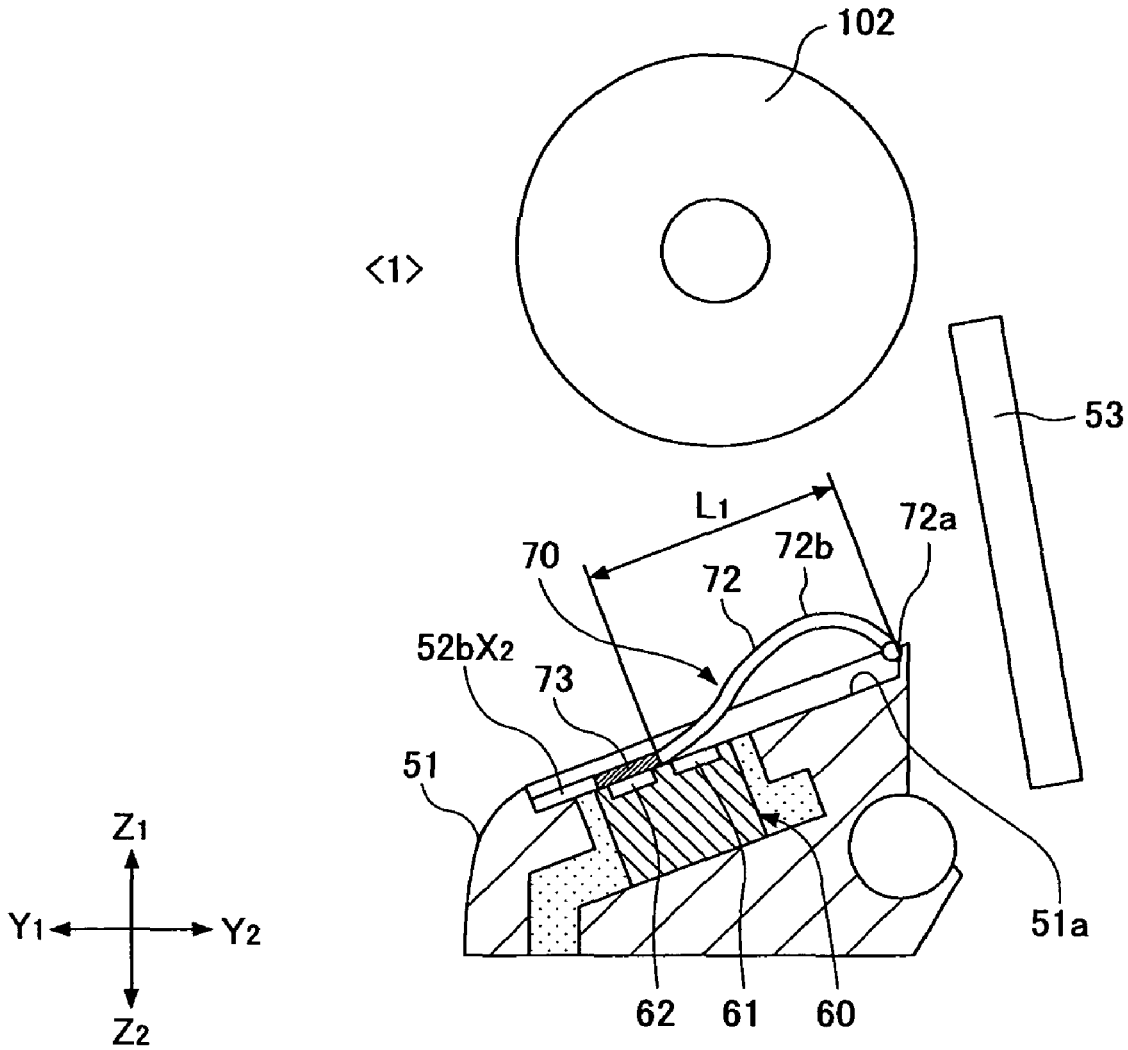
FIG. 10A is a cross-sectional diagram of the status detecting mechanism taken along line XA-XA of FIG. 9A.

As shown in FIG. 10A, the shutter member 70 is attached to the paper guiding part 51 by fixing the base portions 71*a*, 72*a* of the arm parts 71, 72 to the end (Y2 direction end) of the shallow groove part 51*a* and slidably engaging the protruding parts 73X1, 73X2 in the guiding grooves 51*b*X1, 51*b*X2. The function of the optical sensor 60 is controlled (restricted) by having the shutter main body 73 cover the light receiving part 62 of the optical sensor 60. The arcuate curved portions 71*b*, 72*b*, projecting in the Z1 direction are positioned in an area allowing the platen roller 102 to press against the arcuate curved portions 71*b*, 72*b* upon engaging the first module 31.

Figure 9A:
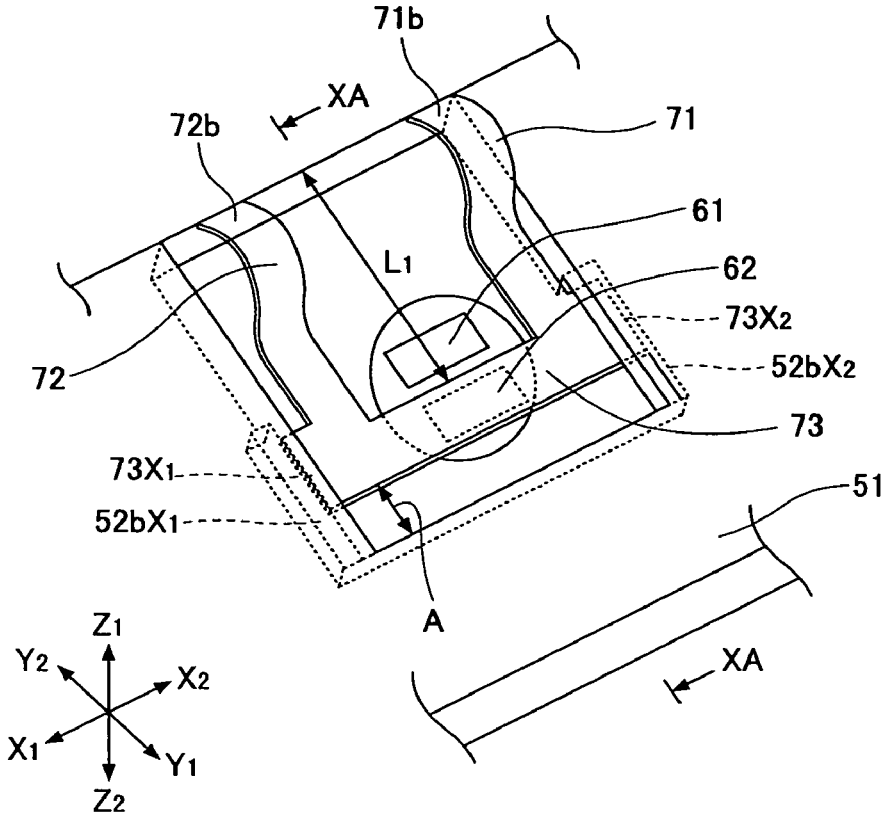
FIG. 9A is a schematic diagram showing a status detecting mechanism before operation according to an embodiment of the present invention.
Figure 9B:
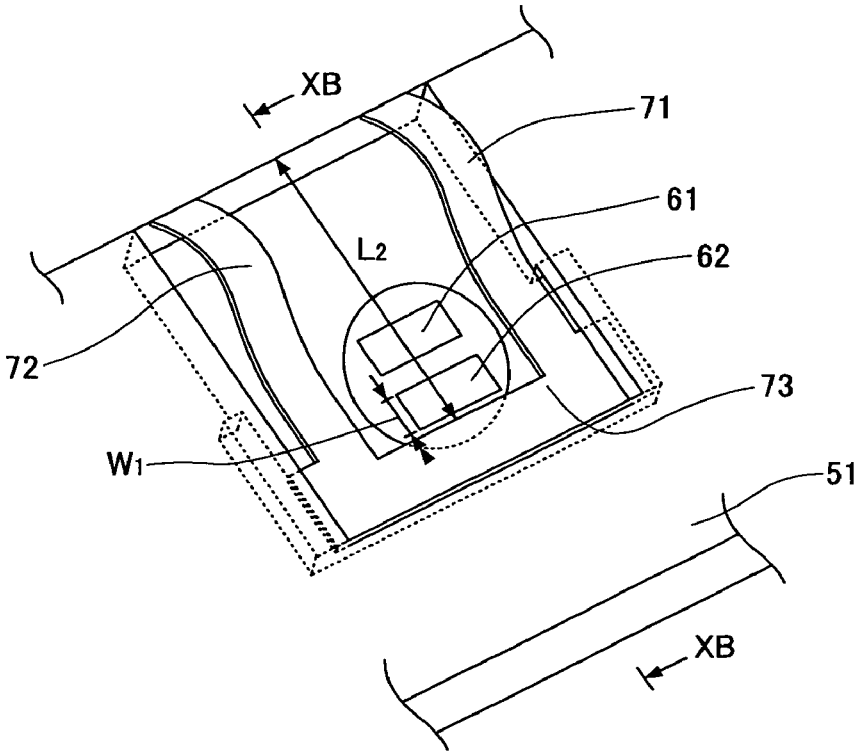
FIG. 9B is a schematic diagram showing a status detecting mechanism during operation according to an embodiment of the present invention.
Figure 10B:
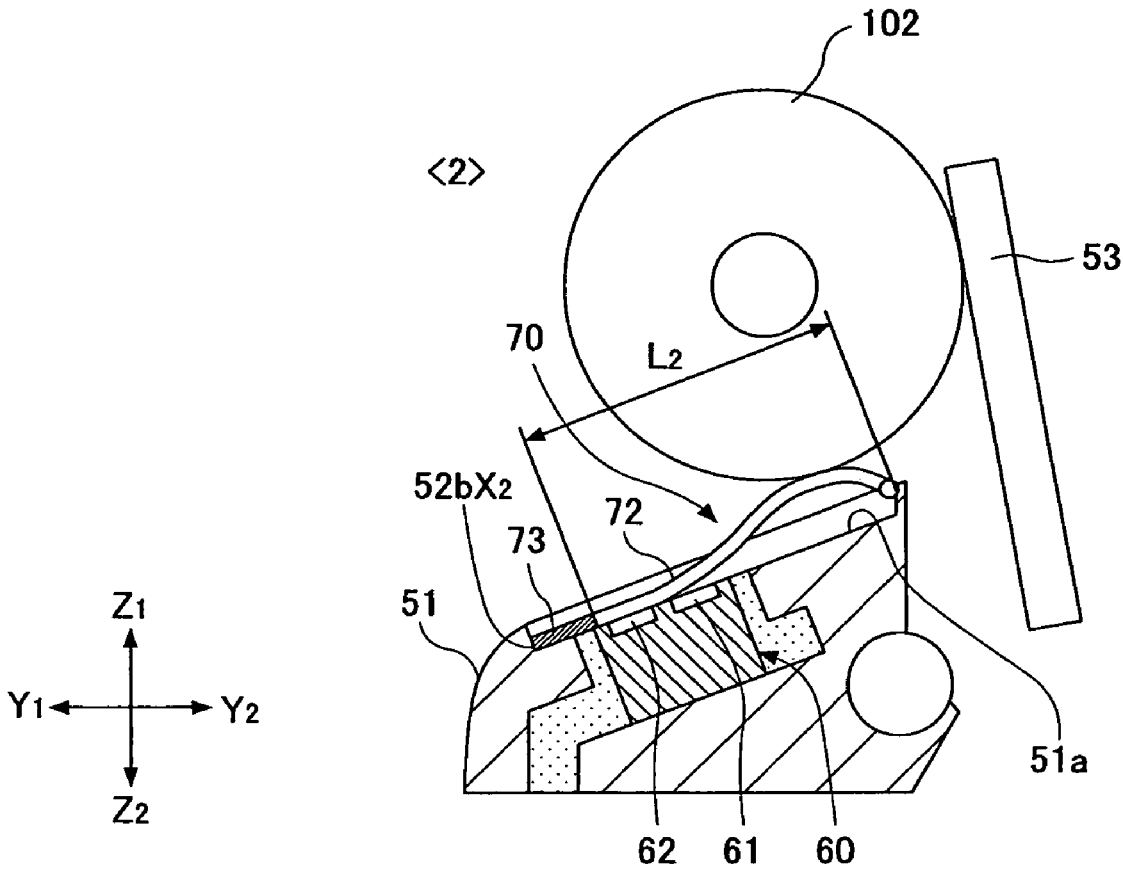
FIG. 10B is a cross-sectional diagram of the status detecting mechanism taken along line XB-XB of FIG. 9B.

When the arcuate curved portions 71*b*, 72*b* become substantially flat due to the pressure applied by the platen roller 102, the distance (length) of the arm parts 71, 72 in the Y1-Y2 direction extends from L1 (see FIGS. 9A, 10A) to L2 (see FIGS. 9B, 10B). Thereby, the shutter main body 73 moves (is displaced) toward the Y1 direction and separates from the light receiving part 62. The displacement of the shutter main body 73 causes the light receiving part 62 to become exposed; that is, the restricted function of the optical sensor 60 is released. Thereby, the optical sensor 60 becomes operable (functioning state). In this functioning state, both the light receiving part 62 and the light emitting part 61 are exposed between the arm parts 71, 72. The shutter main body 73 can smoothly move by extending the length of the arm parts 71, 72 and sliding the protruding parts 73X1, 73X2 along the guiding grooves 51*b*X1, 51*b*X2.

When the pressing force of the platen roller 102 is released, the arcuate curved portions 71*b*, 72*b* flexibly recover to their initial curvature and the distance (length) of the arm parts 71, 72 in the Y1-Y2 direction returns to L1 (see FIGS. 9A, 10A). Thereby, the light receiving part 62 is again covered by the shutter main body 73.

Since the shutter main body 73 can be smoothly guided and prevented from projecting upward (Z1 direction) by the guiding grooves 51*b*X1, 51*b*X2, the shutter main body 73 can be positioned close to the light receiving part 62 and sufficiently cover the light receiving part 62.

Furthermore, as shown in FIGS. 9A and 9B, the moving (sliding) distance A of the shutter main body 73 is a relatively short distance that substantially equals to the width W1 of the light receiving part 62 of the optical sensor 60 in the Y1-Y2 direction. Therefore, the arcuate curved portions 71*b*, 72*b* can be formed with a relatively small size.

As shown in FIG. 5, a circuit board module (not shown) built in the first module 31 has a control circuit (control part) 90, a first pulse motor drive circuit 91, a second pulse motor drive circuit 92, a thermal head drive circuit 93, and a display part drive circuit 94. The control circuit 90 determines whether the thermal printer 30 is in the state <4> shown in the table of FIG. 1 according to the voltage output from the light receiving part 62. More specifically, with reference to FIG. 11E, the control circuit 90 determines whether the output voltage of the light receiving part 62 of the optical sensor 60 is higher than a reference voltage V10 (high range 95-1) or lower than the reference voltage V10 (low range 95-2) based on a program prepared beforehand. In this example, the value of the reference voltage V10 is lower than that of the voltage V1 output in the state <4> but is relatively close to the value of the voltage V1.

[Second Module]

As shown in FIG. 6, the second module 32 has a frame 100. The frame 100 has attached a movable blade member 101 and a platen roller 102. The movable blade member 101 has racks 103X1 and 103X2 provided one on each side. The racks 103X1 and 103X2 are interlocked with corresponding pinions 104X1, 104X2. The platen roller 102 is for delivering the paper 10 by rotating. The platen roller 102 has a gear 105 on one of its ends. Furthermore, gears 106, 107 are provided on the X1 side of the frame 100.

Next, an exemplary operation of the thermal printer 30 is described in a case where the portable device 35 is operated. More specifically, an exemplary operation of the status detecting mechanism 80 is described.

FIGS. 11A-11D correspond to the states shown in the table of FIG. 1. FIGS. 11A-D show the platen roller 102 arranged in a manner corresponding to the engagement states shown in the table of FIG. 1. [State <4> where the second module 32 and the first module 31 are properly engaged while there is thermal paper 10]

FIG. 7A shows where the thermal paper 10 is pulled out from the thermal paper roll 40 and the openable lid 37 is open. When the openable lid 37 is securely closed, the first module 31 and the second module 32 engage as shown in FIG. 7B, to thereby form the thermal printer 30 as shown in FIG. 4. The platen roller 102 is engaged with the first module 31 by locking the axle parts provided on both sides of the platen roller 102 to corresponding platen roller locking members 58X1 and 58X2. As shown in FIG. 10B, the platen roller 102 presses (abuts) against the thermal head 53 for pressing the thermal paper 10 upon the thermal head 53 and also presses (abuts) against the arcuate curved portions 71*b*, 72*b*. The gear 105 interlocks with the first reduction gear array 56. The gear 106 interlocks with the second reduction gear array 57 (See FIGS. 4-6).

Figure 11A:
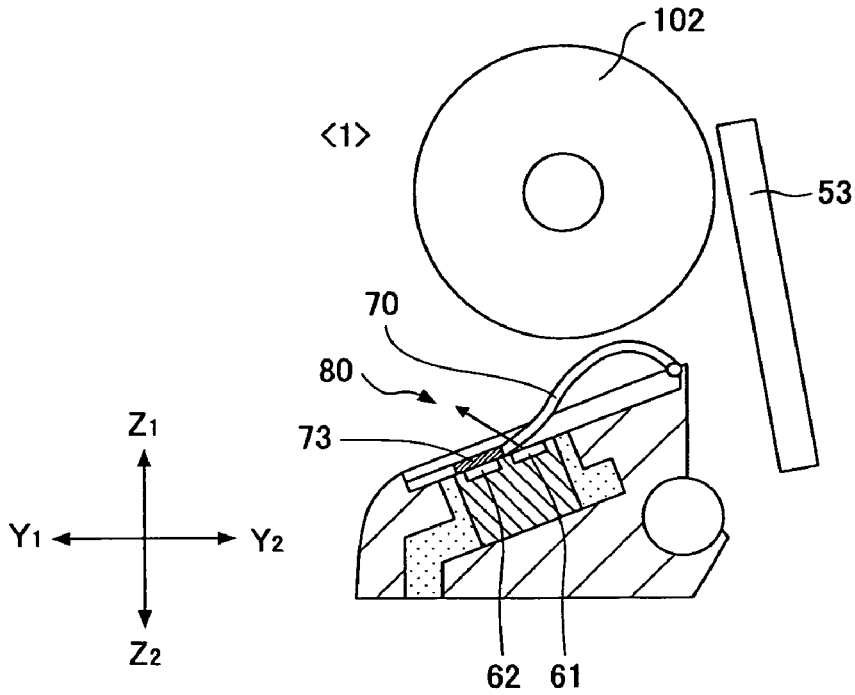
FIGS. 11A-11E are schematic diagrams showing various states of the status detecting mechanism according to an embodiment of the present invention.
Figure 11B:
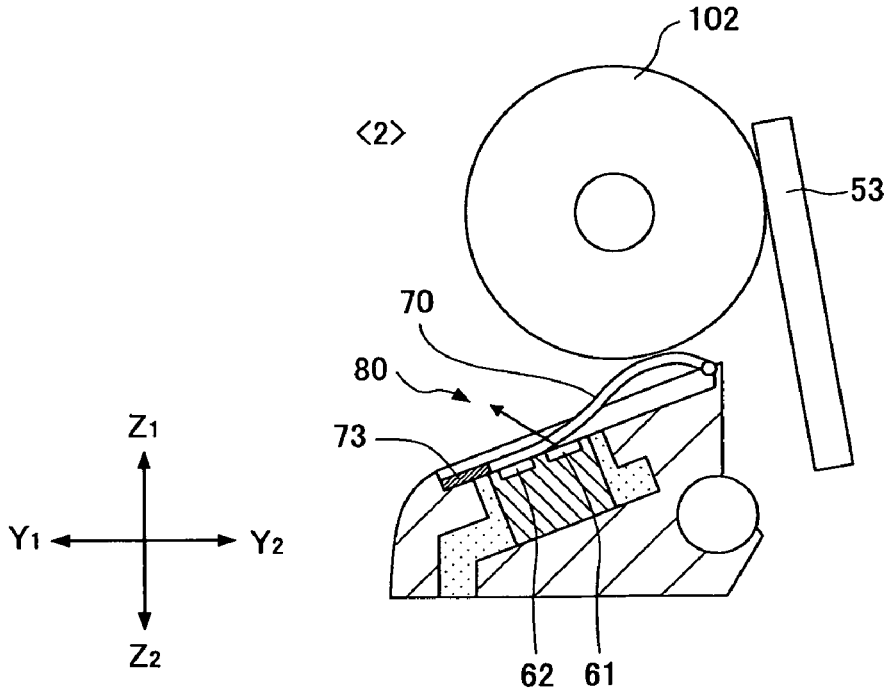
Figure 11C:
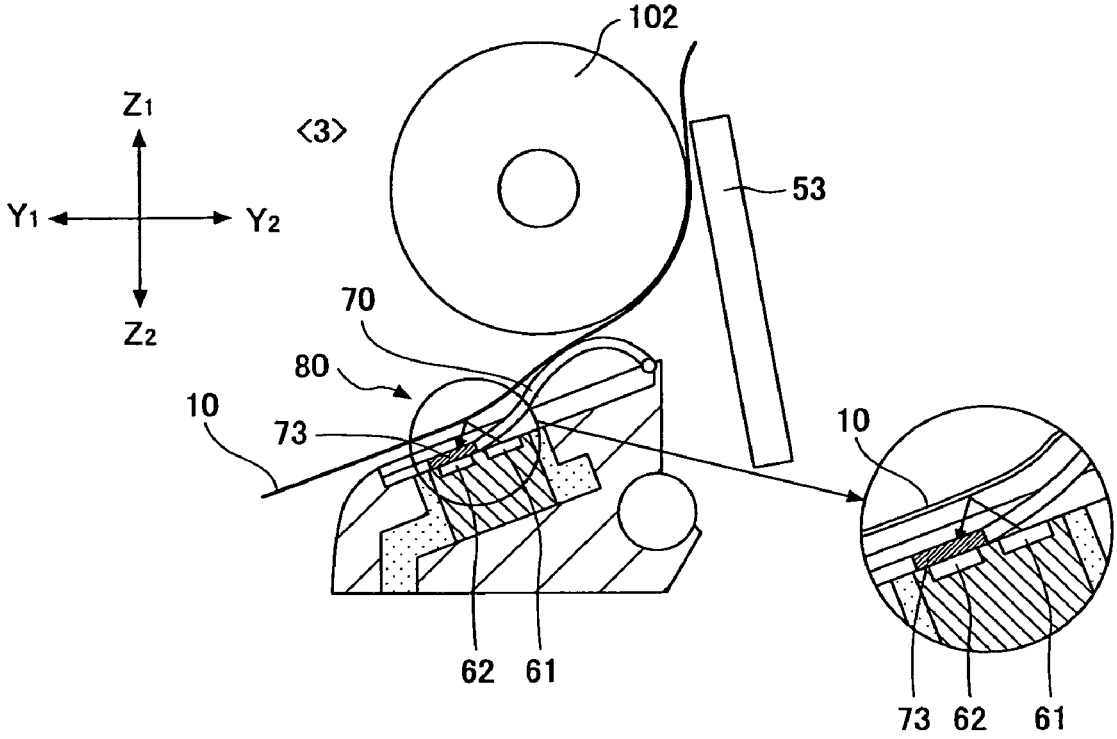
Figure 11D:
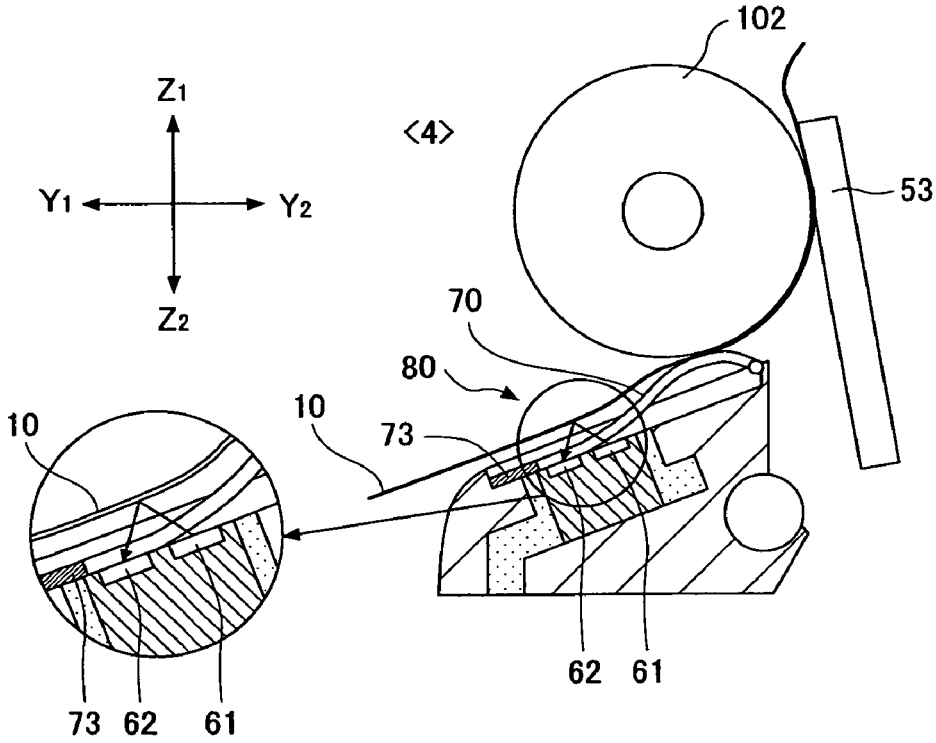

FIG. 11D shows the status detecting mechanism 80 in an operable state according to an embodiment of the present invention.

When the platen roller 102 properly engages the first module 31, the platen roller 102 presses against the arcuate curved portions 71*b*, 72*b* and causes the length of the arm parts 71, 72 to extend. Thereby, the shutter main body 73 moves in the Y1 direction and separates from the light receiving part 62. Accordingly, the light receiving part 62 becomes exposed for receiving light. The light receiving part 62 outputs a predetermined high voltage V1 (see FIG. 11E) based on the light emitted from the light emitting part 61 and reflected from the thermal paper 10.

In a case where the user inputs a command(s) by button operation after the control circuit 90 determines that the voltage V1 is a voltage in the high range 95-1, the control circuit 90 sends instructions, for example, to the drive circuits 91, 92, 93 in accordance with the received command. That is, the control circuit 90 determines that the thermal printer 30 is in the state <4>.

Thus, in accordance with the command input by the button operation of the user, the thermal head drive circuit 93 and the first pulse motor drive circuit 91 are activated for driving the thermal head 53 and the first pulse motor 54. Accordingly, the platen roller 102 is rotated via the first reduction gear array 56 and the gear 105. Thereby, the rotating platen roller 102 delivers (conveys) the thermal paper 10 for printing data, etc., onto the thermal paper 10. Then, the printed thermal paper 10 is discharged.

Even in a case where the thermal paper 10 is loosened (sagging), the thermal paper 10 can be positioned close to the optical sensor 60 in a manner covering the optical sensor 60. In this case, the light receiving part outputs the voltage V1.

Hence, the above-described state <4> can be detected with greater reliability than with the conventional thermal printer regardless of the loosened (sagging) thermal paper 10.

[State <1> where the Second Module 32 and the First Module 31 are not Properly Engaged while there is No Paper]

In a case where the thermal printer 30 is in state <1> in which the openable lid 37 of the portable device 35 is closed, the status detecting mechanism 80 is as shown in FIG. 11A. As shown in FIG. 11A, the shutter main body 73 covers the light receiving part 62 of the optical sensor 60. Thereby, the function of the optical sensor 60 is restricted. Thus, the voltage output from the light receiving part 62 is zero.

In a case where the user inputs a command(s) by button operation after the control circuit 90 determines that the output voltage is a voltage in the low range 95-1, the control circuit 90 denies the input command. That is, the control circuit 90 determines that the thermal printer 30 is in a state other than <4>. Accordingly, the thermal printer 30 remains inactive and does not operate even where the user inputs a command via a button (not shown) of the thermal printer 30.

Furthermore, the control circuit 90 sends an instruction(s) to the display part drive circuit 94 for instructing the display part drive circuit 94 to display a message "the platen roller is not engaged or there is no thermal paper" on a display part. Thereby, the user is prompted to inspect the thermal printer 30.

[State <2> where the Second Module 32 and the First Module 31 are Engaged while there is No Paper]

In a case where the thermal printer 30 is in state <2> in which the openable lid 37 of the portable device 35 is closed, the status detecting mechanism 80 is as shown in FIG. 11B. Although the shutter main body 73 is separated from the light receiving part 62 (i.e. the light receiving part 62 is exposed), no light is incident on the light receiving part 62 since there is no thermal paper 10 to reflect the light emitted from the light emitting part 61. Therefore, the voltage output from the light receiving part 62 is zero.

The control circuit 90 operates in the same manner as the state <1>.

[State <3> where the Second Module 32 and the First Module 31 are not Properly Engaged while there is Paper]

In a case where the thermal printer 30 is in state <3> in which the openable lid 37 of the portable device 35 is closed, the status detecting mechanism 80 is as shown in FIG. 11C.

The part of the thermal paper 10 facing the optical sensor 60 is positioned closely to the optical sensor 60. Accordingly, the light emitted from the light emitting part 61 is incident on the thermal paper 10 and reflected in the direction of the light receiving part 62. However, since the light receiving part 62 is covered by the shutter main body 73, the reflected light is blocked by the shutter main body 73 and does not reach the light receiving part 62. Accordingly, the voltage output from the light receiving part 62 is zero.

Likewise, the control circuit 90 determines that the output voltage of the light receiving part 62 is a voltage in the low range 95-2 and operates in the same manner as the states <1> and <2>.

[State where the Second Module 32 and the First Module 31 are Half-Locked while there is Paper]

Figure 12:
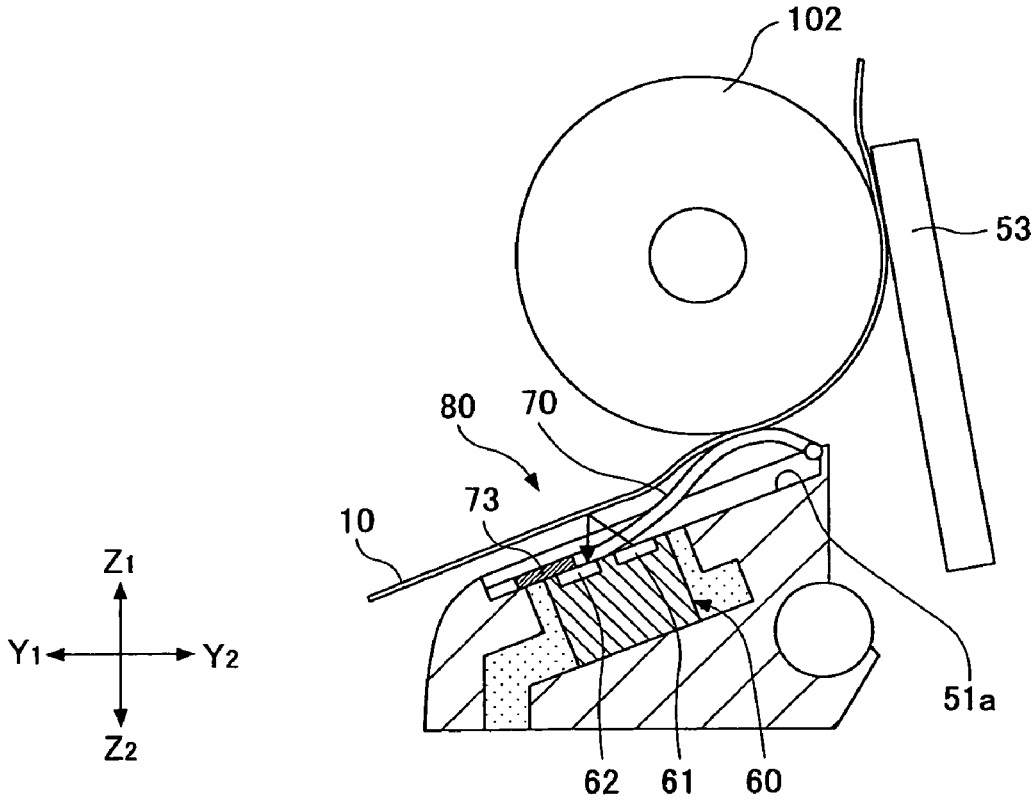
FIG. 12 is a schematic diagram showing a state where the a platen roller is half-locked with respect to a status detecting mechanism according to an embodiment of the present invention.

FIG. 12 shows a state where the second module 32 and the first module 31 are almost sufficiently engaged but not properly engaged while there is paper. The platen roller 102 is half-locked with respect to the platen roller locking members 58X1, 58X2.

Figure 11E:
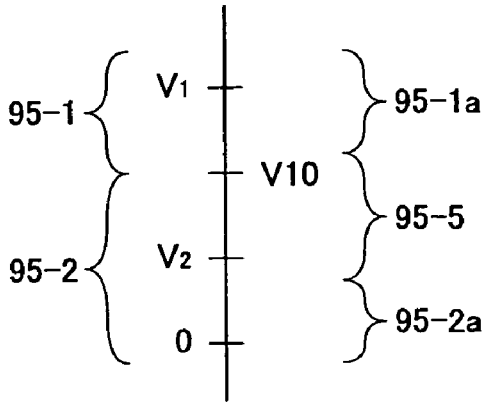

In this state, the platen roller 102 slightly presses against the arcuate curved portions 71*b*, 72*b* to cause the shutter main body 73 to move slightly toward the Y1 direction. Thereby, approximately half of the light receiving part 62 is exposed. The light emitted by the light emitting part 62 and reflected from the thermal paper 10 is incident on the exposed part of the light receiving part 62. Accordingly, the light receiving part 62 outputs a voltage V2 in accordance with the incident reflected light. With reference to FIG. 11E, the voltage V2 output from the light receiving part 62 is lower than the voltage V1.

Accordingly, in a case where the user inputs a command(s) by button operation after the control circuit 90 determines that the output voltage is a voltage in the low range 95-2, the control circuit 90 denies the input command. Thus, the thermal printer 30 remains inactive and does not operate even where the user inputs a command via a button (not shown) of the thermal printer 30.

In a case where the range for determining the output voltage of the light receiving part 62 is divided into three levels 95-1a, 95-5, and 95-2a from the highest order (see right side of FIG. 11E), the control circuit 90 determines that the output voltage V2 of the light receiving part 62 is a voltage in a middle range 95-5. Accordingly, the control circuit 90 denies the input command. Thus, the thermal printer 30 remains inactive and does not operate even where the user inputs a command via a button (not shown) of the thermal printer 30. Furthermore, the control circuit 90 sends an instruction(s) to the display part drive circuit 94 for instructing the display part drive circuit 94 to display a message "the platen roller is half-locked" on a display part.

Figure 13A:
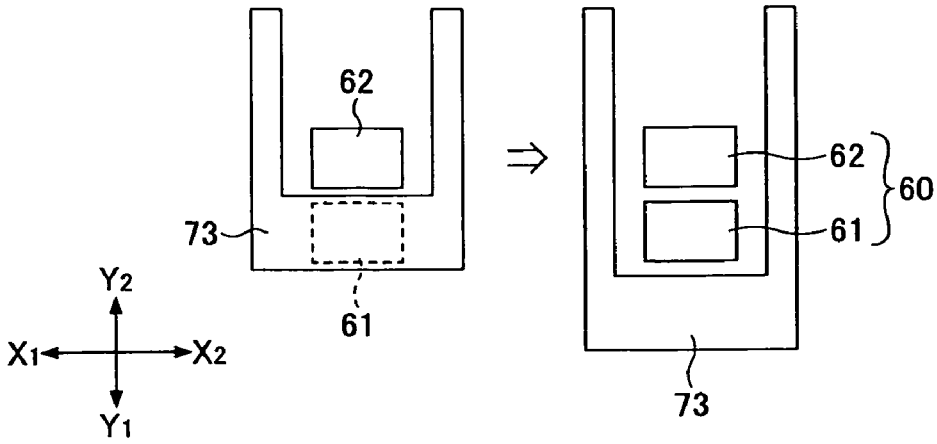
FIGS. 13A-13C are schematic diagrams showing modified examples of arrangements of a shutter member and an optical sensor according to an embodiment of the present invention.
Figure 13B:
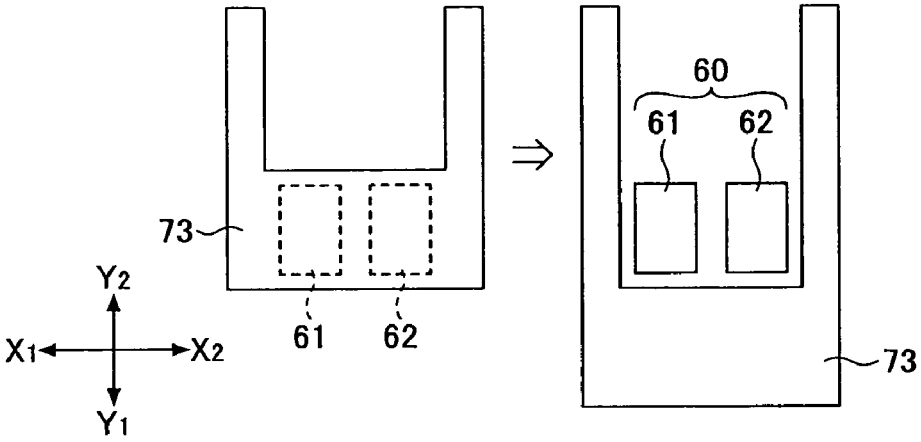
Figure 13C:
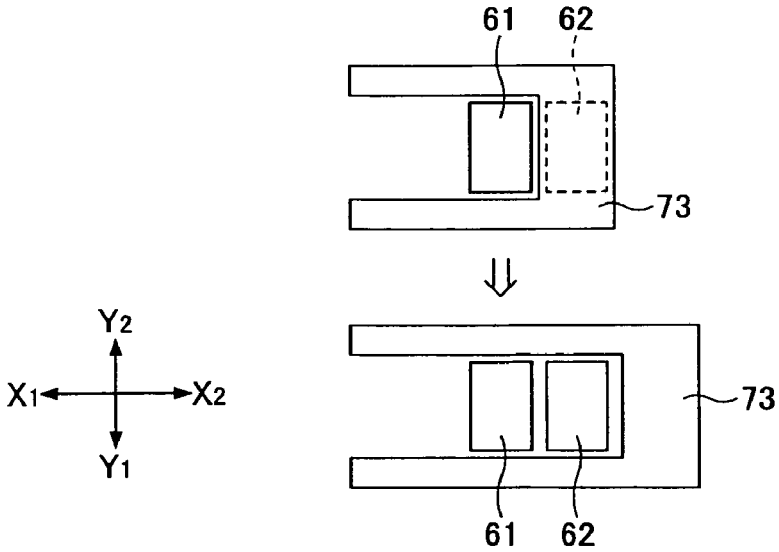

FIGS. 13A-13C are schematic diagrams showing modified examples of the status detecting mechanism 80 according to an embodiment of the present invention.

FIG. 13A shows an exemplary configuration where the shutter main body 73 is displaced from a position covering the light emitting part 61 to a position exposing the light emitting part 61.

FIG. 13B shows another exemplary configuration where the shutter main body 73 is displaced from a position covering the entire optical sensor 60 to a position exposing the optical sensor 60. In this example, the light emitting part 61 and the light receiving part 62 of the optical sensor 60 are aligned in a direction perpendicularly intersecting the moving (displacing) direction of the shutter main body 73.

FIG. 13C shows yet another exemplary configuration where the shutter main body 73 is displaced (moved) in the X1-X2 direction (longitudinal direction) of the paper guiding part 50*a*. With this example, there is substantially no constraint in the length of the shutter member 70. Therefore, the status detecting mechanism 80 can be easily and freely designed.

Furthermore, the shutter member 70 is not limited to a configuration having arcuate curved portions 71*b*, 72*b*. As long as the pressure of the platen roller 102 can cause plastic deformation of the shutter member 70 and displace (extend) the end of the shutter member 70, the shutter member 70 may have a shape or a configuration other than the arcuate curved portions.

Second Embodiment

Figure 14:
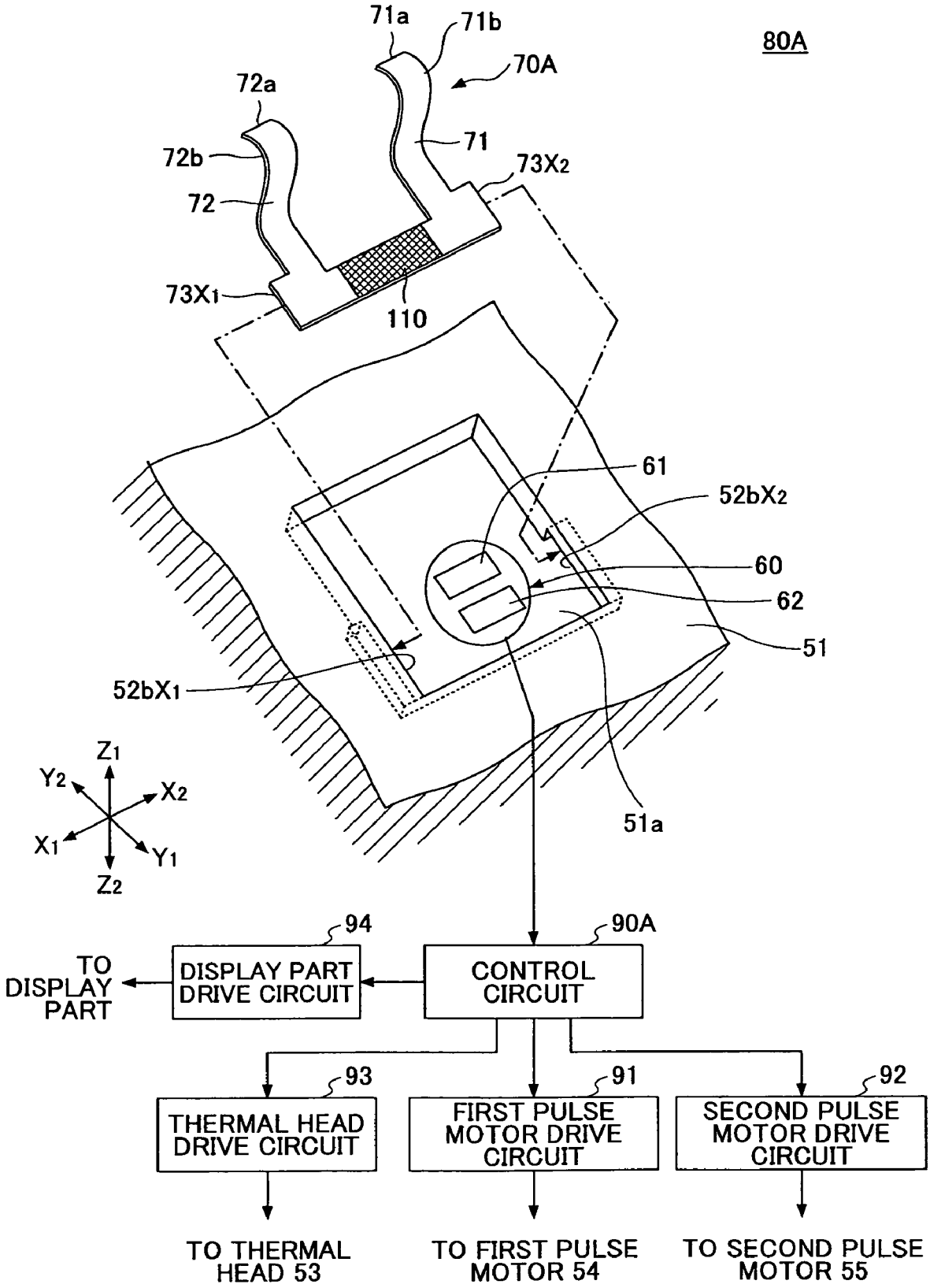
FIG. 14 is a schematic diagram of a status detecting mechanism of a thermal printer according to a second embodiment of the present invention.

FIG. 14 is a schematic diagram showing a status detecting mechanism 80A of the thermal printer 30 according to the second embodiment of the present invention. The status detecting mechanism 80A has a filter member 70A instead of the above-described shutter member 70 of the status detecting mechanism 80. The filter member 70A, serving as a function restriction releasing part, has a translucent filter 110 instead of the above-described shutter main body 73. The translucent filter 110 has a transmittance of, for example, 50%. The light receiving part 62 is covered by the filter 110 when the openable lid 37 of the portable device is open.

Figure 15A:
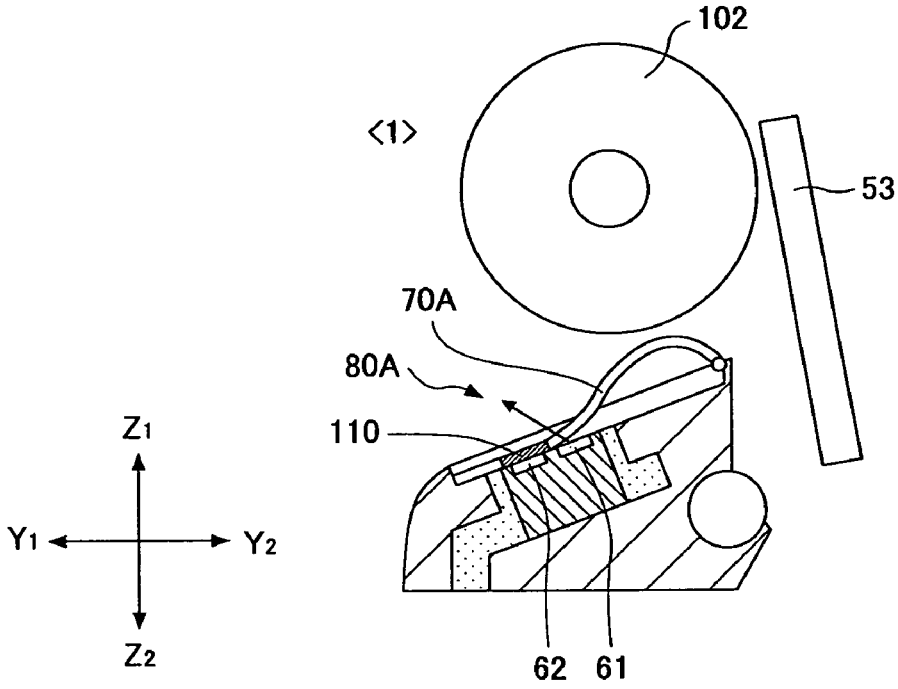
FIGS. 15A-15E are schematic diagrams showing various states of the status detecting mechanism according to another embodiment of the present invention.
Figure 15B:
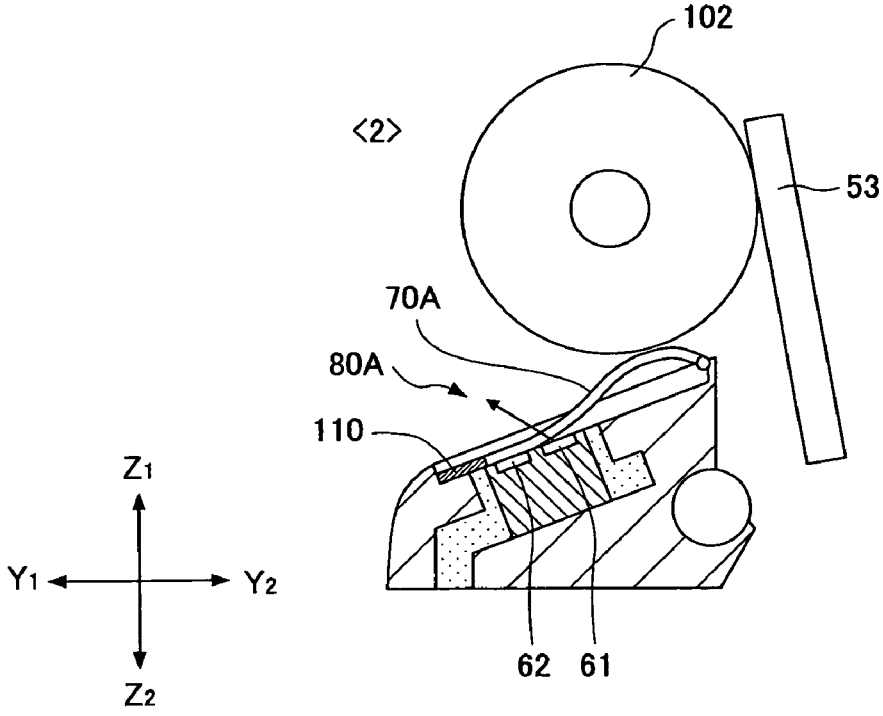
Figure 15C:
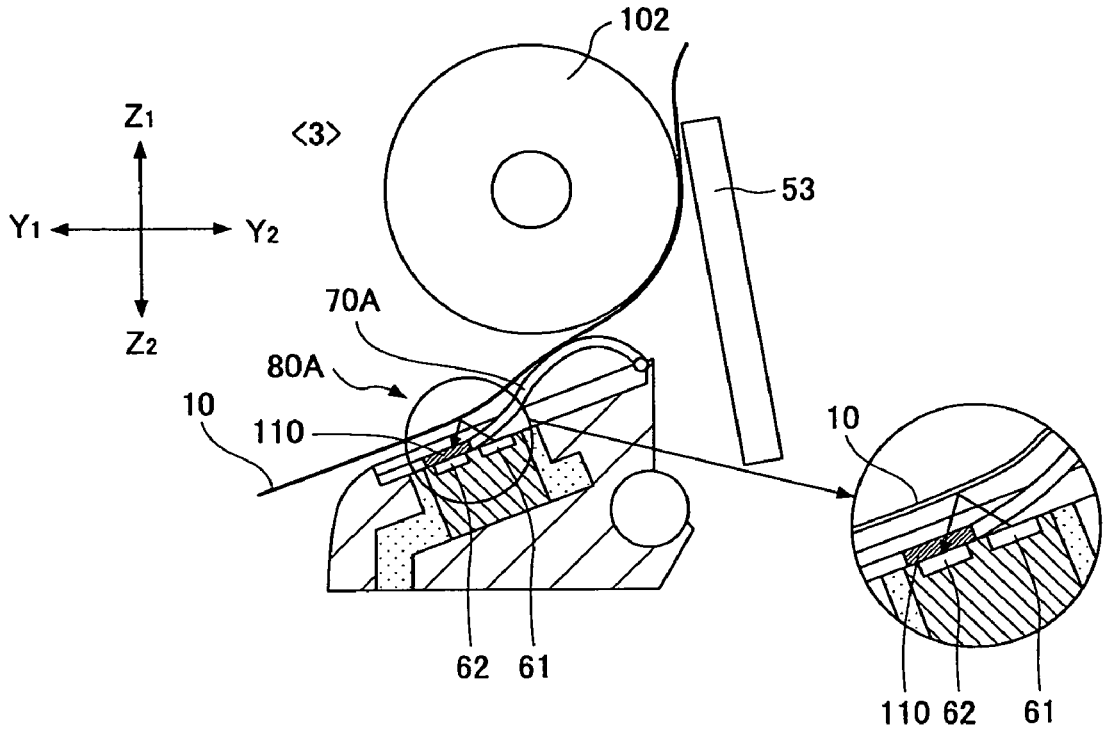
Figure 15D:
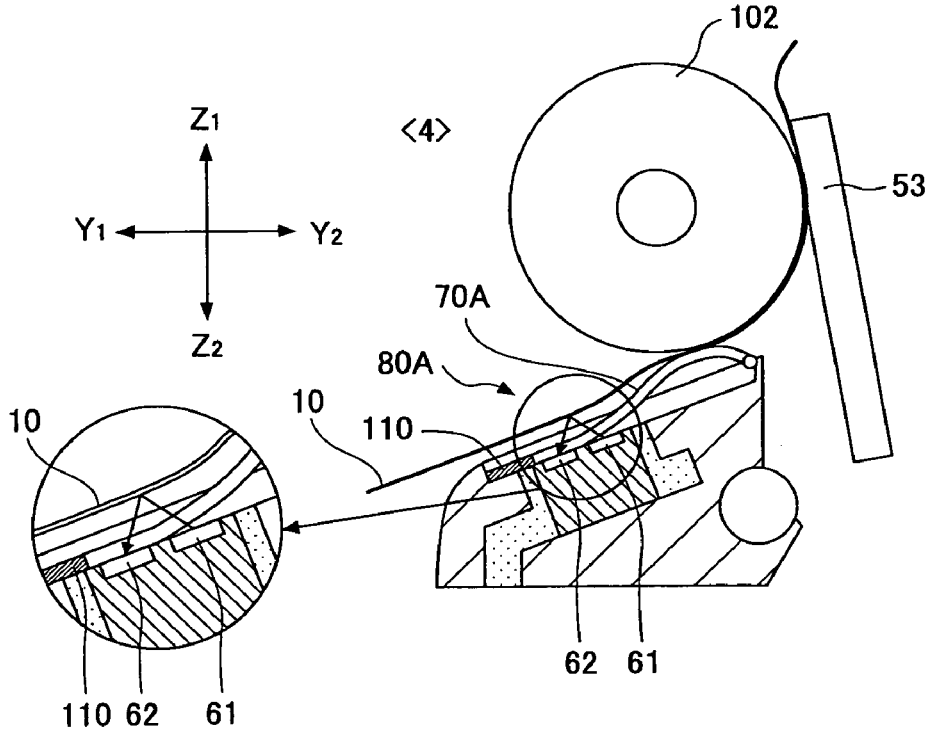
Figure 15E:
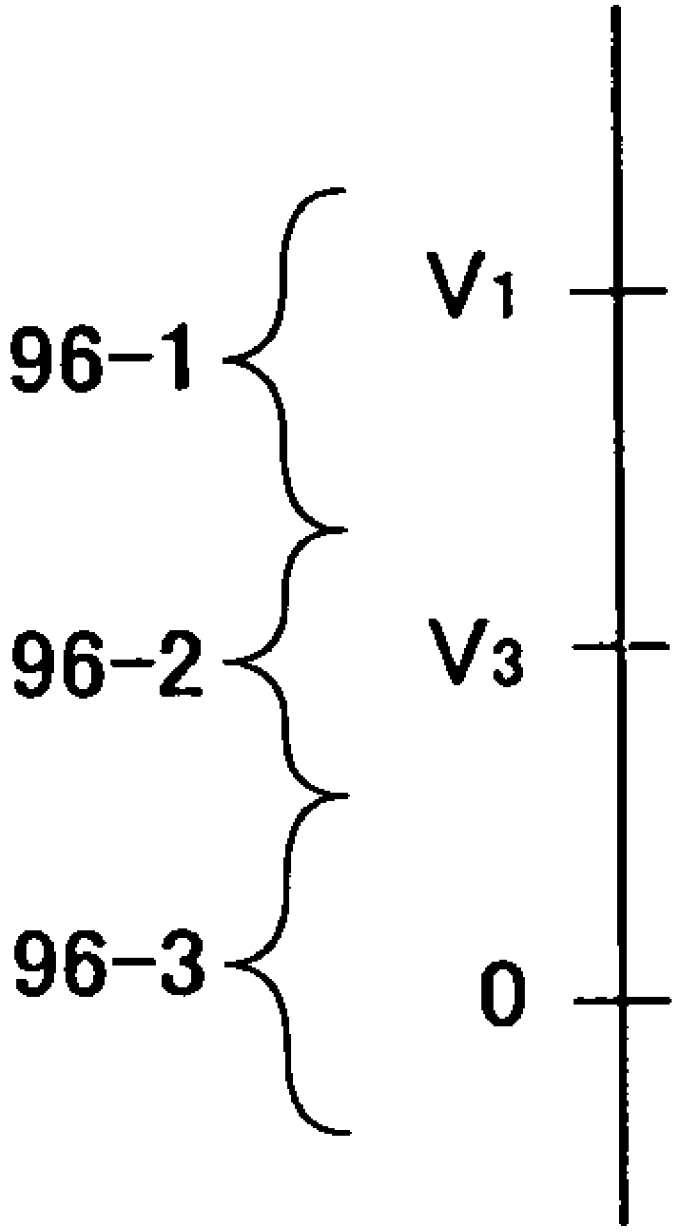

As shown in FIG. 15E, the control circuit 90A determines whether the voltage output from the light receiving part 62 is a voltage in a high range 96-1, a middle range 96-2, or a low range 96-3.

As shown in FIG. 15D, when the thermal printer 30 is in a state <4>, the light receiving part 62 is exposed. Accordingly, the light emitted from the light emitting part 61 and reflected from the thermal paper 10 is incident on the light receiving part 62. In accordance with the received incident light, the light receiving part 62 outputs a high voltage V1.

In a case where the user inputs a command(s) by button operation after the control circuit 90A determines that the voltage V1 is a voltage in the high range 96-1, the control circuit 90A sends instructions, for example, to the drive circuits 91, 92, 93 in accordance with the received command. That is, the control circuit 90A determines that the thermal printer 30 is in the state <4>.

As shown in FIG. 15A, when the thermal printer 30 is in a state <1>, no light emitted from the light emitting part 61 is directed to the light receiving part 62 since there is no paper. Thus, the voltage output from the light receiving part 62 is zero.

In a case where the user inputs a command(s) by button operation after the control circuit 90A determines that the output voltage is a voltage in the low range 96-3, the control circuit 90A denies the input command. That is, the control circuit 90A determines that the thermal printer 30 is in a state other than state <4>. Accordingly, the thermal printer 30 remains inactive and does not operate even where the user inputs a command via a button (not shown) of the thermal printer 30.

Furthermore, the control circuit 90A sends an instruction(s) to the display part drive circuit 94 for instructing the display part drive circuit 94 to display a message "there is no thermal paper" on a display part. Thereby, the user is prompted to inspect the thermal printer 30.

As shown in FIG. 15B, when the thermal printer 30 is in the state <2>, no light emitted from the light emitting part 61 is directed to the light receiving part 62 since there is no paper. Thus, the voltage output from the light receiving part 62 is zero. Likewise, the control circuit 90A operates in the same manner as the state <1>. That is, the control circuit 90A denies the input command, remains inactive and does not operate even where the user inputs a command via a button (not shown) of the thermal printer 30. Furthermore, the control circuit 90A sends an instruction(s) to the display part drive circuit 94 for instructing the display part drive circuit 94 to display a message "there is no thermal paper" on a display part.

As shown in FIG. 15C, when the thermal printer 30 is in the state <3>, the light emitted from the light emitting part 61 is reflected from the thermal paper 10 and directed to the light receiving part 62. The reflected light is attenuated as it transmits through the filter 110 and reaches the light receiving part 62. In accordance with the received incident light, the light receiving part 62 outputs a voltage V3. The voltage V3 is lower than the voltage V1.

In a case where the user inputs a command(s) by button operation after the control circuit 90A determines that the output voltage is a voltage in the middle range 96-2, the control circuit 90A denies the input command. Furthermore, the control circuit 90A sends another instruction(s) to the display part drive circuit 94 for instructing the display part drive circuit 94 to display a message "the platen roller is not engaged" on a display part.

In the first embodiment of the present invention, since the display part displays a selective message ("the platen roller is not engaged or there is no thermal paper"), the user is required check that the platen roller is sufficiently engaged by pressing down on the openable lid. If the message still appears on the display part, the user is required to open the openable lid and set the thermal paper. Therefore, in some cases, there will be a need for the user to conduct two steps before printing with the thermal printer.

However, since only a single message is displayed in the second embodiment of the present invention, the user is only required to conduct a single step according to the message displayed in the display part. For example, in a case where a message "there is no thermal paper" is displayed, the user needs only to open the openable lid and set the thermal paper. Likewise, in a case where a message "the platen roller is not engaged" is displayed, the user needs only to firmly press down on the openable lid and secure the engagement of the platen roller.

It is to be noted that the transmittance of the filter 110 may be altered according to circumstance. Furthermore, in a case where the openable lid 37 of the portable device is open, the filter 110 may be covering the light receiving part 62 and the light emitting part 61 (i.e. entire optical sensor 60).

Figure 16:
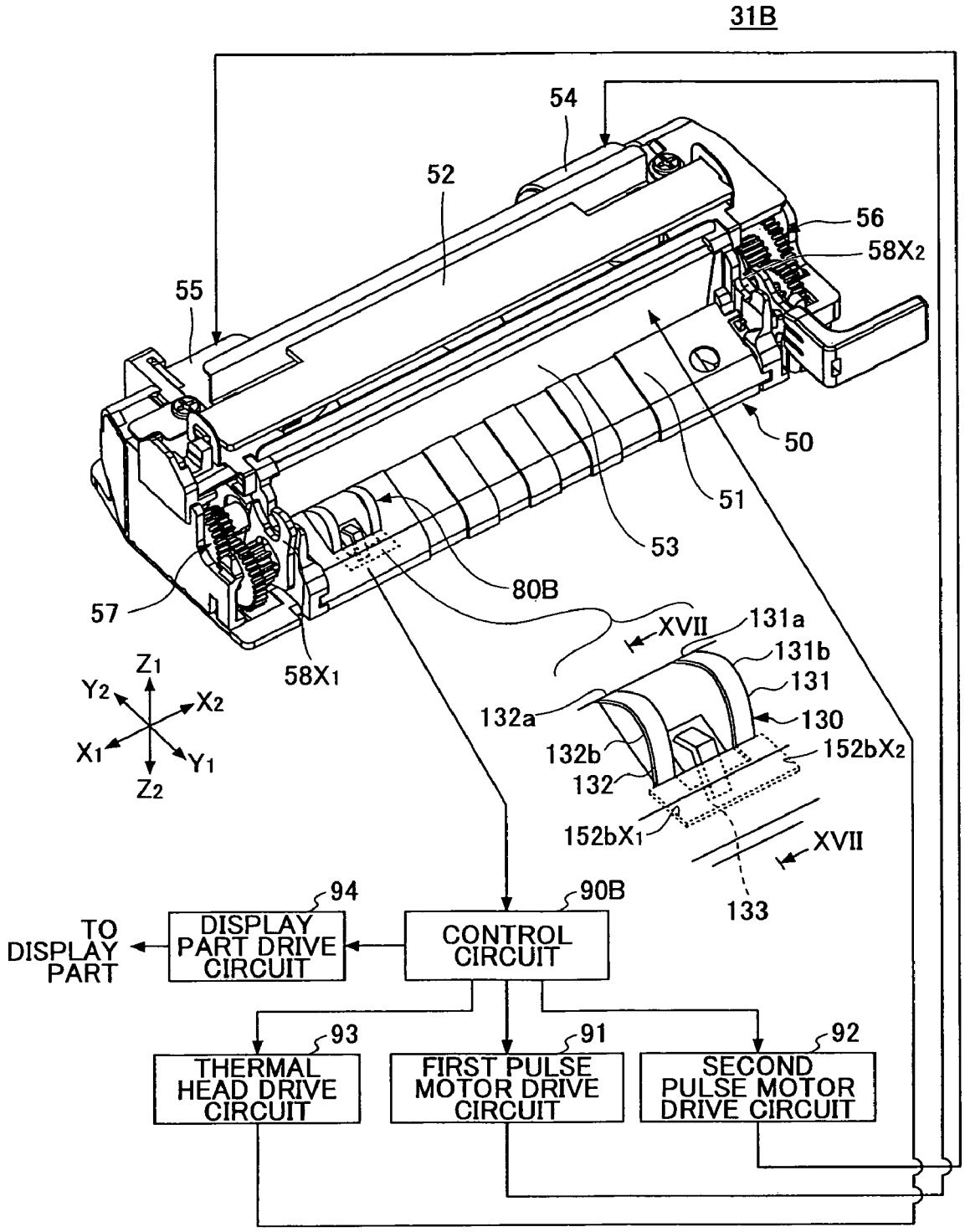
FIG. 16 is a schematic diagram of a status detecting mechanism of a thermal printer according to a third embodiment of the present invention.
Figure 17:
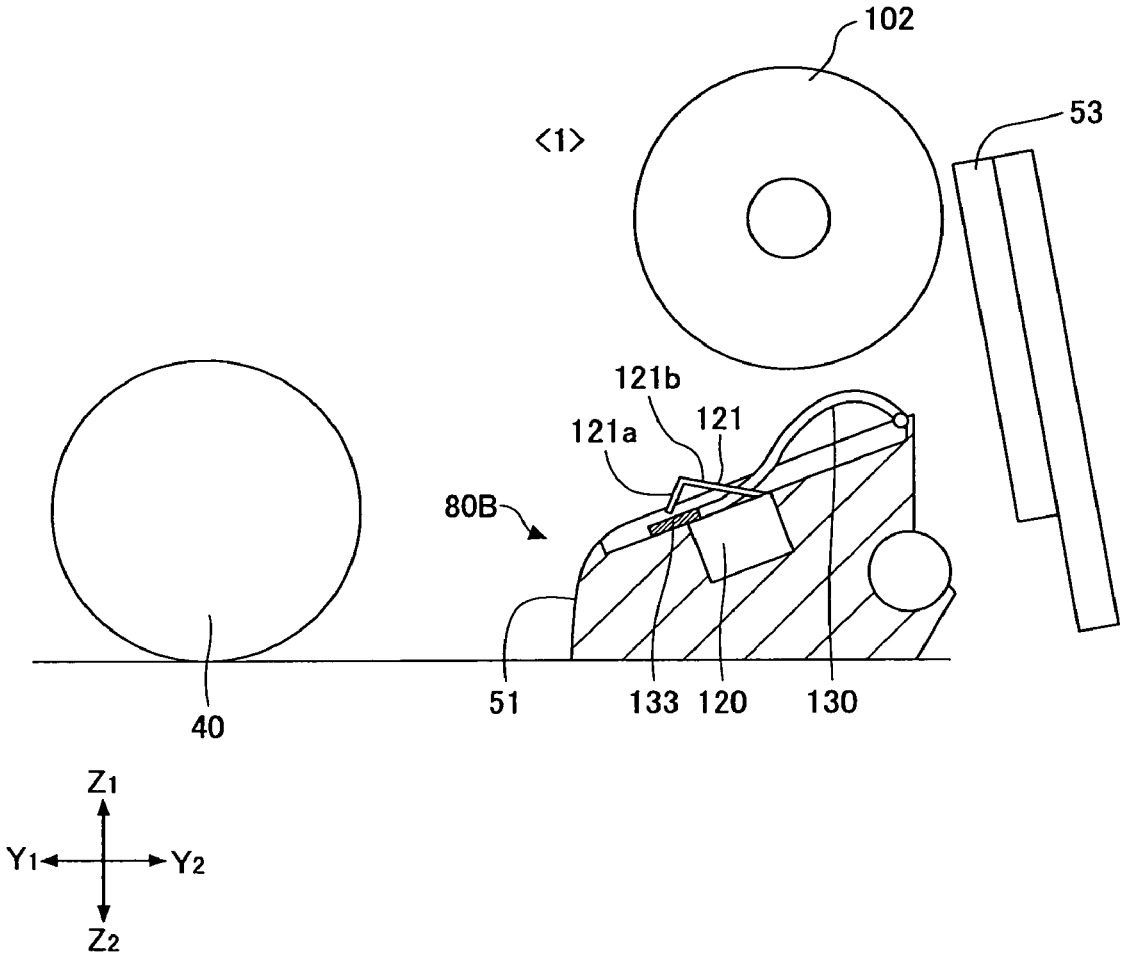
FIG. 17 is a cross-sectional diagram of a status detecting mechanism taken along line XVII-XVII of FIG. 16.

FIG. 16 is a schematic diagram showing a first module 31B of the thermal printer 30 according to the third embodiment of the present invention. The first module 31B has a status detecting mechanism 80B. FIG. 17 is an enlarged view showing the status detecting mechanism 80B. The status detecting mechanism 80B according to the third embodiment of the present invention is provided with a mechanical switch 120 instead of the optical sensor 60. Furthermore, the status detecting mechanism 80B according to the third embodiment of the present invention is provided with a locking member 130 instead of the shutter member 70.

The mechanical switch 120 serving as a detecting part has an actuator lever 121 having an upside-down V shape. The mechanical switch 120 is normally switched off. When the actuator lever 121 is displaced (pressed), the mechanical switch 120 is switched on. In FIG. 17, reference numeral 121*a* indicates a tip portion of the actuator lever 121, and reference numeral 121*b* indicates an apex portion of the upside-down V shaped actuator lever 121. The mechanical switch 120 is fixed to the paper guiding part 51 in a manner facing the Y1 direction and having its apex portion 121*b* facing the Z1 direction. The apex portion 121*b* is positioned in such manner so that a tensioned paper 10 can be pressed thereto.

The locking member 130 serving as a function restriction releasing part has substantially the same shape as the above-described shutter member 70. More specifically, the locking member 130 has substantially a U-shape. For example, the locking member 130 is formed of a planar material made of metal, rubber, or elastomer. Furthermore, the locking member 130 includes two substantially parallel arm parts 131, 132 and a coupling part 133 for coupling the ends of the arm parts 131, 132. Each of the arm parts 131, 132 has an arcuate curved portion 131*b*, 132*b* projecting in the Z1 direction.

The locking member 130 according to an embodiment of the present invention is attached to the paper guiding part 51 by fixing the base portions 131*a*, 132*a* of the arm parts 131, 132 to the end (Y2 direction end) of the paper guiding part 51 and slidably (slidable in the Y1 direction) engaging the coupling part 133 into guiding parts 152*b*X1, 152*b*X2 of the paper guiding part 51. The coupling part 133 locks the actuator lever 121 by engaging with the tip portion 121*a* (toward the Z2 direction) of the actuator lever 121. Thereby, movement of the actuator lever 121 is restricted. Accordingly, the function of the mechanical switch 120 is restricted.

In a case where the mechanical switch 120 is off, a control circuit 90B denies a command input by button operation by the user. In a case where the mechanical switch 120 is on, the control circuit 90B accepts the input command and controls, for example, the operation of the drive circuits 91, 92, 93.

FIG. 17 shows the thermal printer 30 in the state <1> where the mechanical switch 120 is off (restricted from switching on).

[State <4> where the Second Module 32 and the First Module 31*b* are Properly Engaged while there is Thermal Paper 10]

Figure 18:
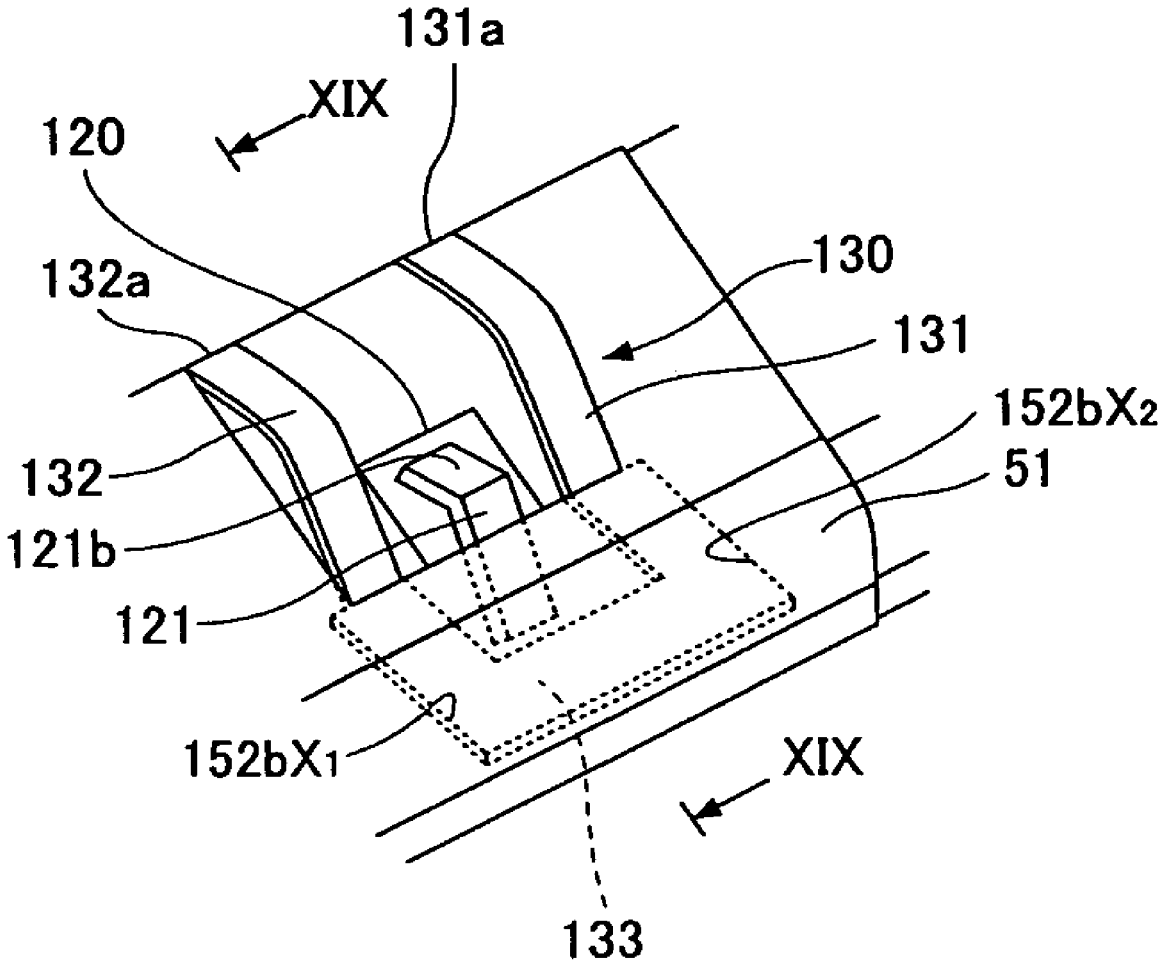
FIG. 18 is a schematic diagram showing a status detecting mechanism in operation according to an embodiment of the present invention.
Figure 19:
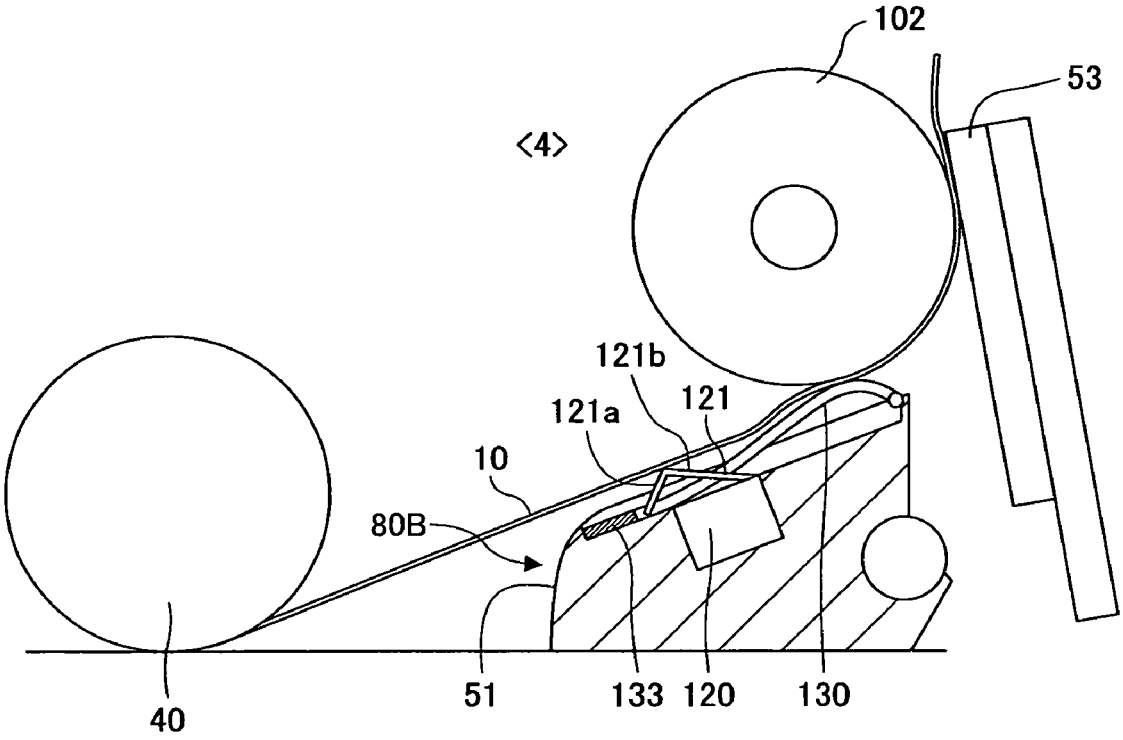
FIG. 19 is a cross-sectional diagram showing a status detecting mechanism taken along line XIX-XIX of FIG. 18.

The state <4> of the status detecting mechanism 80B according to the third embodiment of the present invention is described with reference to FIGS. 18 and 19. The platen roller 102 presses against the arcuate curved portions 131*b*, 132*b* and causes the length of the arm parts 131, 132 to extend. Thereby, the coupling part 133 moves in the Y1 direction and separates from the tip portion 121*a* of the actuator lever 121. Accordingly, the locked state of the actuator lever 121 is released by disengaging the coupling part. Thereby, the actuator lever 12 can move to the Z2 direction.

A tensioned thermal paper 10 abuts the apex portion 121*b* of the actuator lever 121 and presses against the actuator lever 121. Thereby, the actuator lever 121 is displaced. The displacement of the actuator lever 121 switches on the mechanical switch 120.

Accordingly, the control circuit 90B accepts the input command and controls, for example, the operation of the drive circuits 91, 92, 93. Thereby, the thermal printer 30 becomes operable.

[State <1> where the Second Module 32 and the First Module 31 are not Properly Engaged while there is No Paper]

The state <1> of the status detecting mechanism 80B according to the third embodiment of the present invention is described with reference to FIG. 17. In FIG. 17, the mechanical switch 120 is off. Thus, even in a case where the user inputs a command by button operation, the control circuit 90B denies the command input by the user. Accordingly, the thermal printer 30 remains inactive and does not operate even where the user inputs a command via a button (not shown) of the thermal printer 30.

[State <2> where the Second Module 32 and the First Module 31 are Engaged while there is No Paper]

Figure 20A:
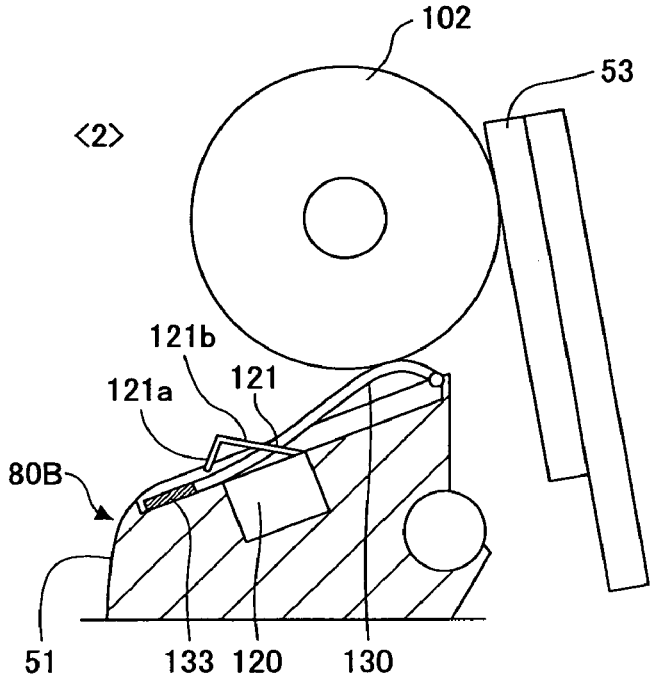
FIGS. 20A-20B are schematic diagrams showing various states of the status detecting mechanism according to yet another embodiment of the present invention.

The state <2> of the status detecting mechanism 80B according to the third embodiment of the present invention is described with reference to FIG. 20A. In FIG. 20A, the locked state of the actuator lever 121 is released by disengaging the coupling part 133. However, since there is no paper 10, the actuator lever 121 is not pressed down. Therefore, the mechanical switch 120 remains off. Thus, even in a case where the user inputs a command by button operation, the control circuit 90B denies the command input by the user. Accordingly, the thermal printer 30 remains inactive and does not operate even where the user inputs a command via a button (not shown) of the thermal printer 30.

[State <3> where the Second Module 32 and the First Module 31 are not Properly Engaged while there is Paper]

Figure 20B:
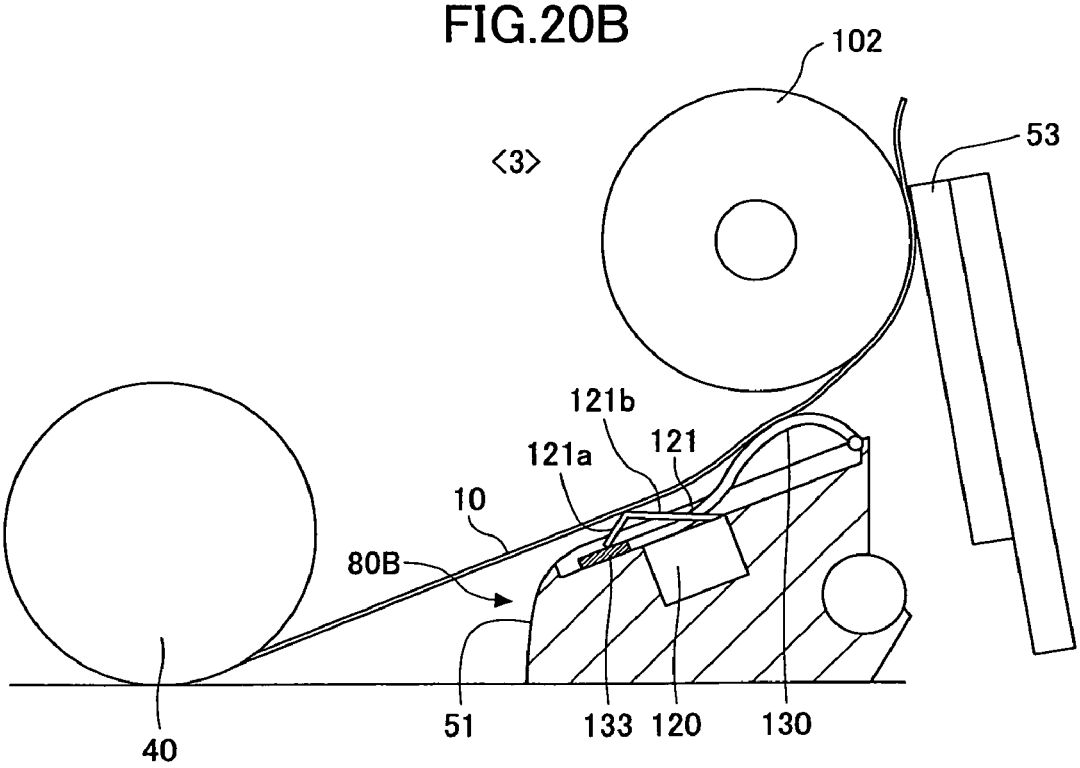

The state <3> of the status detecting mechanism 80B according to the third embodiment of the present invention is described with reference to FIG. 20B. In FIG. 20B, the actuator lever 121 is locked by the coupling part 133. Accordingly, even if pressure is applied to the actuator lever 121 by the thermal paper 10, the actuator lever 121 is prevented from being pressed down. Therefore, the mechanical switch 120 remains off. Thus, even in a case where the user inputs a command by button operation, the control circuit 90B denies the command input by the user. Accordingly, the thermal printer 30 remains inactive and does not operate even where the user inputs a command via a button (not shown) of the thermal printer 30.

Figure 2A:
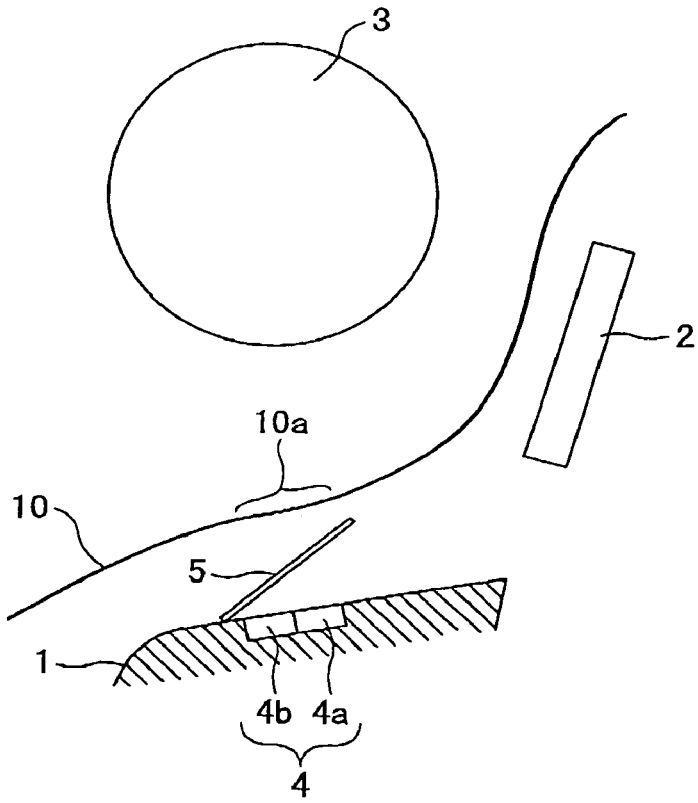
FIG.2A RELATED ART
FIGS. 2A-2E are schematic diagrams showing an example of a conventional thermal printer.
Figure 2B:
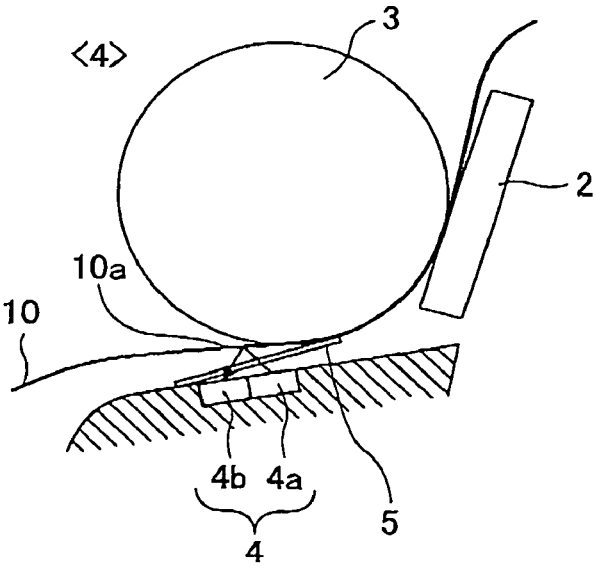
FIG.2B RELATED ART
Figure 2C:
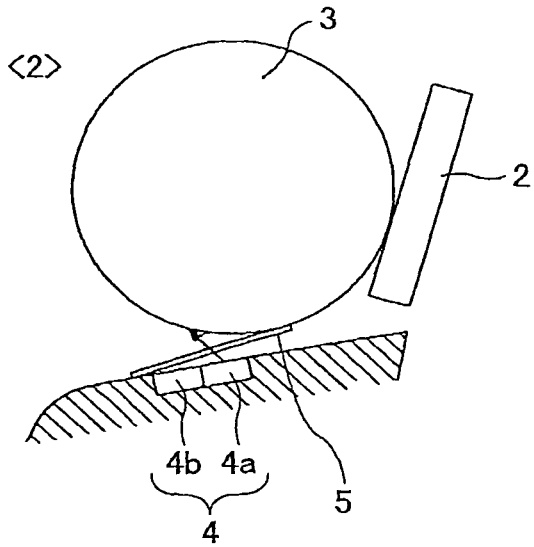
FIG.2C RELATED ART
Figure 2D:
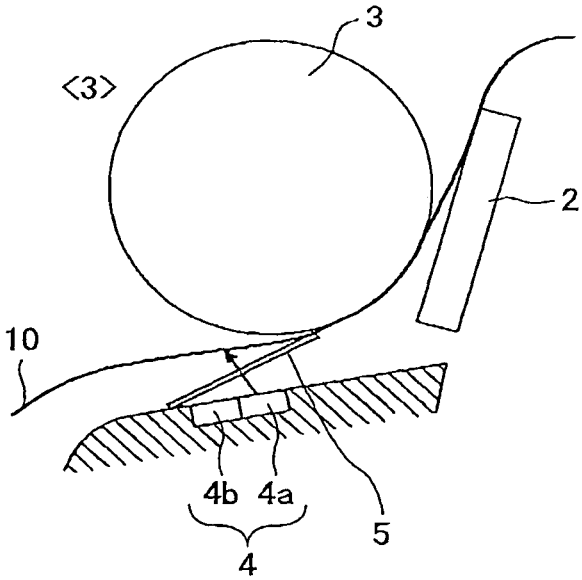
FIG.2D RELATED ART
Figure 2E:
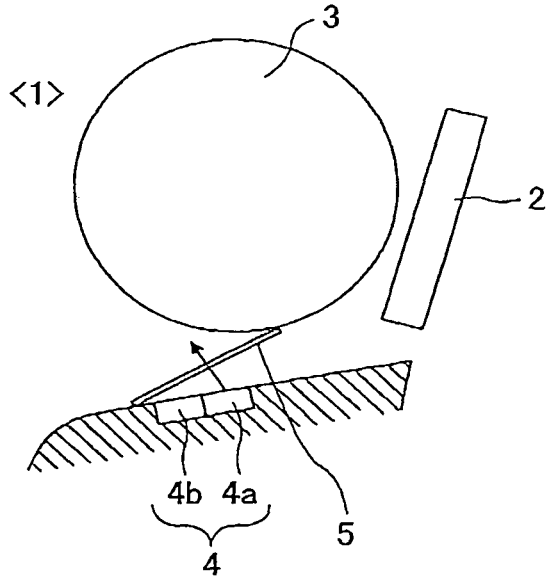
FIG.2E RELATED ART
Figure 3A:
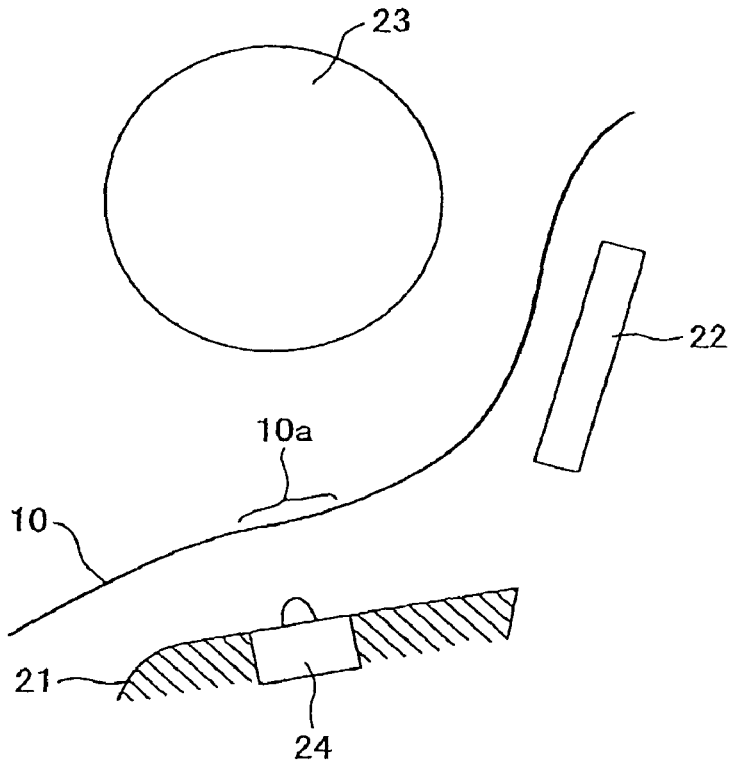
FIG.3A RELATED ART
FIGS. 3A-3E are schematic diagrams showing another example of a conventional thermal printer.
Figure 3B:
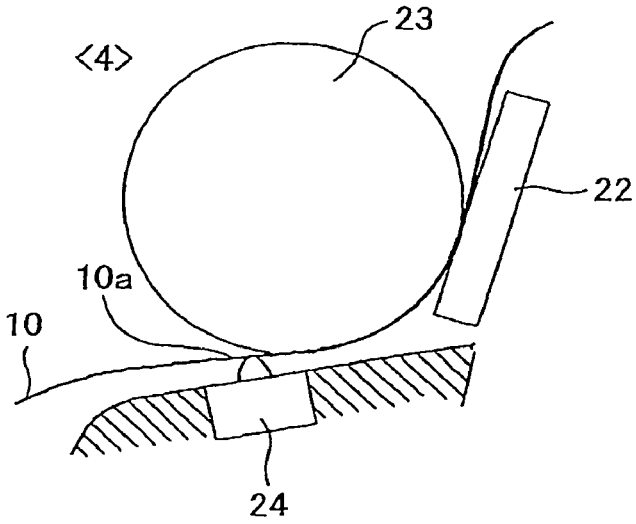
FIG.3B RELATED ART
Figure 3C:
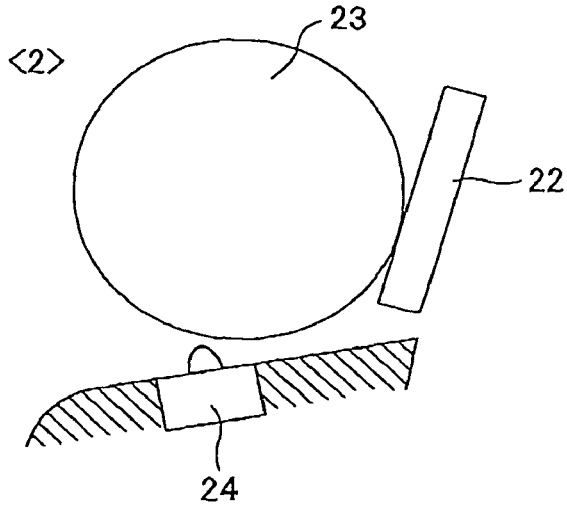
FIG.3C RELATED ART
Figure 3D:
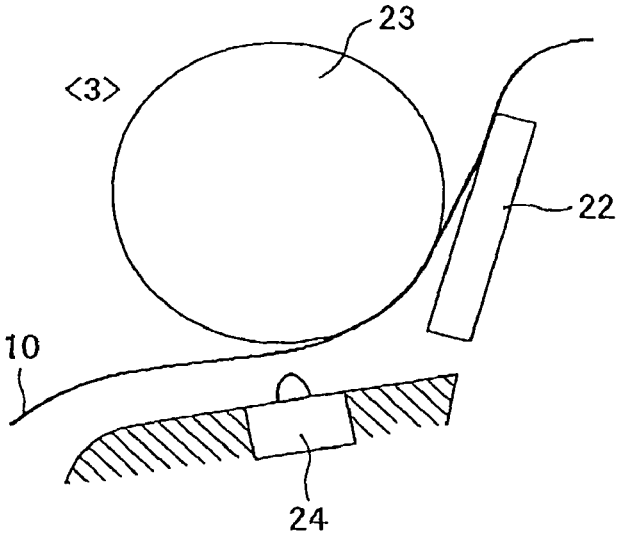
FIG.3D RELATED ART
Figure 3E:
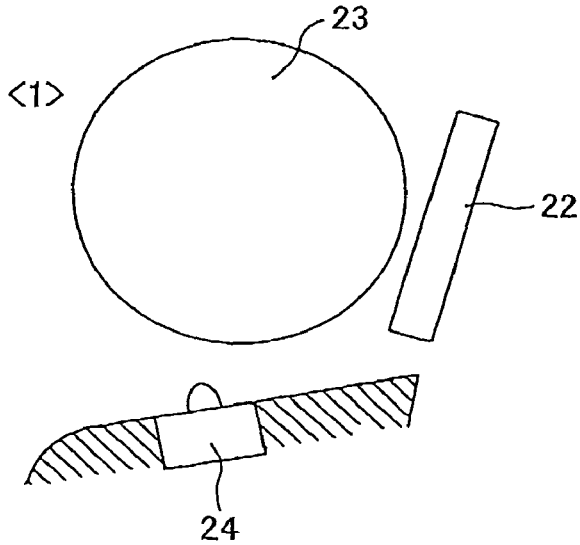
FIG.3E RELATED ART

Hence, with the thermal printer 30 according to the third embodiment of the present invention, the actuator lever 121 remains locked by engaging with the coupling part 133. Thus, even in a case where thermal paper 10 having a significantly high tension is used, the mechanical switch 120 is reliably switched off. Thus, the detection reliability in the state <3> is higher than that of FIG. 3D.

Modified Example

It is to be noted that, although the embodiments of the present invention is described with a thermal printer, other printers having a printing head other than a thermal head may also be used.

Furthermore, other configurations besides a configuration to which pressure (force) is directly applied from the platen roller 102 to the shutter member 70, the filter member 70A, or the locking member 130 may be used as long as the configuration is displaced by application of pressure (force) via a given member when the platen roller 102 engages the first module 31.

Alternatively, instead of a configuration where the second module 32 is engaged with the first module 31, a configuration engaging the platen roller 102 with the first module 31 may be used.

Further, the present invention is not limited to these embodiments, but variations and modifications may be made without departing from the scope of the present invention.

The present application is based on Japanese Priority Application No. 2007-179361 filed on Jul. 9, 2007, with the Japanese Patent Office, the entire contents of which are hereby incorporated by reference.

What is claimed is:

1. A printer having a platen roller and a module that are engageable with each other to print on paper, the printer comprising:

a status detecting mechanism including a detecting part having a detection function detecting a status of the printer;

a restricting part restricting the detection function of the detecting part; and a function restriction releasing part releasing the restricted function of the detecting part;

the engagement of the platen roller and the module displacing the function restriction releasing part, and the displacement causing the function restriction releasing part to release the restricted function of the detecting part.

2. The printer as claimed in claim 1, wherein the displacement of the function restriction releasing part is caused by a pressure applied from the platen roller when the platen roller and the module are engaged.

3. The printer as claimed in claim 1, wherein the function restriction releasing part includes at least one arm part, wherein the arm part has a curved portion projecting in the direction toward the platen roller, wherein the engagement of the platen roller and the module causes extension of the length of the arm part, wherein the extension causes the displacement of the function restriction releasing part.

4. The printer as claimed in claim 1, wherein the function restriction releasing part includes at least one arm part, wherein the arm part has a curved portion projecting in the direction toward the platen roller, wherein the detecting part is an optical sensor covered by the function restriction releasing part, wherein the engagement of the platen roller and the module causes extension of the length of the arm part, wherein the extension causes the displacement of the function restriction releasing part, wherein the optical sensor is exposed by the displacement of the function restriction releasing part.

5. The printer as claimed in claim 1, wherein the detecting part is an optical sensor including a light emitting part and a light receiving part, wherein the function restriction releasing part is a shutter member configured to cover the light receiving part when the platen roller and the module are disengaged and to expose the light receiving part when the platen roller and the module are engaged.

6. The printer as claimed in claim 5, wherein the module includes a guiding part guiding the shutter member.

7. The printer as claimed in claim 1, wherein the detecting part is an optical sensor including a light emitting part and a light receiving part, wherein the function restriction releasing part is a shutter member configured to cover the light emitting part when the platen roller and the module are disengaged and to expose the light emitting part when the platen roller and the module are engaged.

8. The printer as claimed in claim 1, wherein the detecting part is an optical sensor including a light emitting part and a light receiving part, wherein the function restriction releasing part is a shutter member configured to cover the light receiving part and the light emitting part when the platen roller and the module are disengaged and to expose the light receiving part and the light emitting part when the platen roller and the module are engaged.

9. The printer as claimed in claim 1, wherein the detecting part is an optical sensor including a light emitting part and a light receiving part, wherein the function restriction releasing part is a shutter member configured to cover the entire light receiving part when the platen roller and the module are disengaged, to partly expose the light receiving part when the platen roller and the module are insufficiently engaged, and to entirely expose the light receiving part when the platen roller and the module are sufficiently engaged.

10. The printer as claimed in claim 9, further comprising:

a control part determining, based on voltage output from the light receiving part, whether the printer is in a state where the light receiving part is entirely covered by the shutter member, a state where the light receiving part is partly exposed while there is paper, or a state where the light receiving part is entirely exposed while there is paper.

11. The printer as claimed in claim 1, wherein the detecting part is an optical sensor including a light emitting part and a light receiving part, wherein the function restriction releasing part is a filter member configured to cover the entire light receiving part when the platen roller and the module are disengaged and to expose the entire light receiving part when the platen roller and the module are engaged.

12. The printer as claimed in claim 11, further comprising:

a control part determining, based on voltage output from the light receiving part, whether the printer is in a state where there is no paper, a state where the light receiving part is covered by the filter member while there is paper, or a state where the entire light receiving part is exposed while there is paper.

13. The printer as claimed in claim 11, wherein the module includes a guiding part guiding the filter member.

14. The printer as claimed in claim 1, wherein the detecting part is a mechanical switch including an actuator lever switching the mechanical switch on and off, wherein the function restriction releasing part is a locking member configured to lock the actuator lever when the platen roller and the module are disengaged and to unlock the actuator lever when the platen roller and the module are engaged.

15. The printer as claimed in claim 14, wherein the module includes a guiding part guiding the locking member.

16. A portable device comprising:

the printer as claimed in claim 1.

17. The printer as claimed in claim 1, wherein the engagement of the platen roller and the module displaces the restricting part.

18. The printer as claimed in claim 1, wherein the platen roller selectively contacts the function restriction releasing part.

19. The printer as claimed in claim 1, wherein the displacement of the function restriction releasing part displaces the restricting part.

* * * * *